US011470888B2

(12) United States Patent
Zeidman

(10) Patent No.: US 11,470,888 B2
(45) **Date of Patent: *Oct. 18, 2022**

(54) INFANT SWADDLING

(71) Applicant: Hindi R. Zeidman, Upland, CA (US)

(72) Inventor: Hindi R. Zeidman, Upland, CA (US)

( * ) Notice: Subject to any disclaimer, the term of this patent is extended or adjusted under 35 U.S.C. 154(b) by 102 days.

This patent is subject to a terminal disclaimer.

(21) Appl. No.: 17/021,381

(22) Filed: Sep. 15, 2020

(65) Prior Publication Data

US 2021/0068472 A1 Mar. 11, 2021

Related U.S. Application Data

(63) Continuation of application No. 16/257,451, filed on Jan. 25, 2019, now Pat. No. 10,779,580, which is a continuation of application No. 14/045,408, filed on Oct. 3, 2013, now Pat. No. 10,188,150.

(51) Int. Cl.
*A47G 9/08* (2006.01)
*A41B 13/06* (2006.01)

(52) U.S. Cl.
CPC ..... *A41B 13/06* (2013.01); *A47G 9/083* (2013.01); *A41B 2300/332* (2013.01)

(58) Field of Classification Search
CPC ... A41B 13/06; A41B 13/065; A41B 2300/30; A41B 2300/332; A47B 9/08; A47B 9/083
See application file for complete search history.

(56) References Cited

U.S. PATENT DOCUMENTS 211,077 A 12/1878 Watson
1,584,853 A 5/1926 Derm
2,429,168 A 10/1947 Padgett
2,469,700 A * 5/1949 Petroceill ..... A41B 13/06 2/69.5
2,530,464 A 11/1950 Haman
2,812,516 A 11/1957 Hoffman
2,989,753 A 6/1961 Burner
3,034,132 A 5/1962 Bernard et al.
3,259,126 A 7/1966 Greiert
4,125,903 A 11/1978 Farrell
(Continued)

FOREIGN PATENT DOCUMENTS

CH 114792 * 4/1926
DE 102010047125 4/2015
(Continued)

OTHER PUBLICATIONS

U.S. Appl. No. 16/739,773, filed Jan. 10, 2020, Zeidman.
(Continued)

*Primary Examiner* — Patricia L Engle

(74) *Attorney, Agent, or Firm* — Knobbe, Martens, Olson & Bear, LLP

(57) ABSTRACT

Infant swaddling allows an infant to be comfortably and easily swaddled. The swaddling includes a pouch featuring a lower end that can be opened and closed to allow an infant's soiled diaper to be easily removed and replaced or to take a rectal temperature. The swaddling can include a blanket that comprises a first blanket flap and a second blanket flap and that can be removably attached to the pouch. The swaddle is used by placing one of the blanket flaps over the pouch, and then placing the other blanket flap over the pouch.

20 Claims, 13 Drawing Sheets

(56) References Cited

U.S. PATENT DOCUMENTS

| | | | |
|---|---|---|---|
| 4,172,300 | A | 10/1979 | Miller |
| 4,347,629 | A | 9/1982 | Itoi |
| 4,688,270 | A | 8/1987 | Denicola et al. |
| 4,759,082 | A | 7/1988 | Mulligan |
| 4,897,885 | A | 2/1990 | Lunt |
| 4,979,250 | A | 12/1990 | Troncone et al. |
| 5,062,168 | A | 11/1991 | Kocib |
| 5,611,095 | A | 3/1997 | Schneider |
| 5,722,094 | A | 3/1998 | Ruefer |
| 5,815,833 | A | 10/1998 | Kuo |
| 5,852,827 | A | 12/1998 | Lear |
| 6,009,576 | A | 1/2000 | Gramme et al. |
| 6,055,686 | A | 5/2000 | Knight |
| 6,145,932 | A | 11/2000 | Hamel-Hyhus et al. |
| 6,415,442 | B1 | 7/2002 | Smith |
| 6,457,193 | B1 | 10/2002 | Li |
| 6,868,566 | B2 | 3/2005 | Gatten |
| D504,753 | S | 5/2005 | Gold et al. |
| 6,928,674 | B2 | 8/2005 | Blackburn |
| 6,978,479 | B2 | 12/2005 | Thach |
| 7,043,783 | B2 | 5/2006 | Gatten |
| 7,076,819 | B2 | 7/2006 | Trani et al. |
| 7,150,055 | B2 | 12/2006 | Wooten, Jr. |
| 7,181,789 | B2 | 2/2007 | Gatten |
| 7,246,392 | B2 | 7/2007 | Schmid et al. |
| 7,254,849 | B1 | 8/2007 | Fiebrich et al. |
| 7,647,658 | B2 | 1/2010 | Wilson |
| 7,739,748 | B2 | 6/2010 | Nilforushan et al. |
| 7,774,875 | B1 | 8/2010 | Zeidman |
| 8,191,189 | B1 | 6/2012 | Spell |
| D691,781 | S | 10/2013 | Coats |
| 8,793,813 | B2 | 8/2014 | Waters |
| RE45,903 | E | 3/2016 | Zeidman |
| RE46,611 | E | 11/2017 | Zeidman |
| 10,188,150 | B2 | 1/2019 | Zeidman |
| 10,188,151 | B2 | 1/2019 | Zeidman |
| RE47,809 | E | 1/2020 | Zeidman |
| 10,779,579 | B2 | 9/2020 | Zeidman |
| 10,779,580 | B2 | 9/2020 | Zeidman |
| RE48,330 | E | 12/2020 | Zeidman |
| 2004/0158925 | A1 | 8/2004 | Sims |
| 2006/0236441 | A1 | 10/2006 | Johnson et al. |
| 2007/0056098 | A1 | 3/2007 | Schmid et al. |
| 2008/0235848 | A1 | 10/2008 | Wilder et al. |
| 2011/0179546 | A1 | 7/2011 | Millette et al. |
| 2011/0231993 | A1 | 9/2011 | Schmid et al. |
| 2012/0023637 | A1 | 2/2012 | Neveu |
| 2012/0110716 | A1 | 5/2012 | Christensen et al. |
| 2013/0302555 | A1 | 11/2013 | Dunn et al. |
| 2014/0033430 | A1* | 2/2014 | Daugherty ..... A41B 13/06 5/494 |
| 2014/0033431 | A1 | 2/2014 | Zeidman |
| 2014/0298564 | A1 | 10/2014 | Miller |
| 2015/0342263 | A1* | 12/2015 | Taylor ..... A41B 13/06 2/69.5 |
| 2016/0174619 | A1* | 6/2016 | Waters ..... A41B 13/06 2/69.5 |
| 2016/0295928 | A1 | 10/2016 | Bopanna et al. |
| 2017/0049158 | A1 | 2/2017 | Zeidman |
| 2019/0208831 | A1 | 7/2019 | Joshi |
| 2019/0223515 | A1 | 7/2019 | Zeidman |
| 2019/0223516 | A1 | 7/2019 | Zeidman |
| 2020/0237024 | A1* | 7/2020 | Glazer ..... A41B 13/06 |
| 2021/0059318 | A1 | 3/2021 | Zeidman |

FOREIGN PATENT DOCUMENTS

| | | |
|---|---|---|
| DE | 102016008165 | 1/2018 |
| DE | 102016008165 A1 * | 1/2018 |
| DE | 102018105989 | 9/2019 |
| FR | 2967870 | 6/2012 |

OTHER PUBLICATIONS

U.S. Appl. No. 17/021,782, filed Sep. 15, 2020, Zeidman.

Aug. 3, 2021, Complaint, *Hindi R. Zeidman* v. *Freshly Picked, LLC* (1:21-cv-01129-CFC).

* cited by examiner

INFANT SWADDLING

CROSS-REFERENCE TO RELATED AND OTHER APPLICATIONS

This is a continuation of U.S. patent application Ser. No. 16/257,451 filed Jan. 25, 2019, which is a continuation of U.S. patent application Ser. No. 14/045,408, filed Oct. 3, 2013. This disclosure references various features of U.S. patent application Ser. No. 13/571,009, filed Aug. 9, 2012, which is an application for reissue of U.S. Pat. No. 7,774,875, which issued on Aug. 17, 2012, from U.S. patent application Ser. No. 12/381,131, filed Mar. 6, 2009. The entire contents of each of these documents are incorporated by reference.

BACKGROUND

Field

The disclosure generally pertains to the field of infant swaddling.

Description of the Related Art

Archaeological records indicate that infant swaddling was first used around 4000 B.C. in the desert regions of Central Asia in combination with a back-pack cradle board. As time progressed, the migration of people from region to region became a relatively permanent way of life. Swaddling subsequently also became a common part of child-rearing.

Early swaddling used a square piece of cloth. The infant was laid on the cloth diagonally and the corners of the cloth were folded over the feet, body and under the head, and the corners were tied to hold the cloth in position. Swaddling typically formed the clothing for an infant until the infant was about a year old. The confinement provided by the swaddling provided warmth and security for the infant who had recently left the mother's womb.

Today, swaddling is a standard newborn care practice in most hospitals. Swaddling is useful for keeping the baby warm and comfortable, without increasing the risk of Sudden Infant Death Syndrome (SIDS).

Current infant swaddling makes it easier to swaddle an infant than with traditional square cloths. Nevertheless, a wakeful infant can loosen the swaddling and kick the swaddling off. Accordingly, a need remains for swaddling that is more readily maintained in place on an infant.

SUMMARY

Infant swaddling and methods of swaddling are disclosed in various embodiments. The swaddling includes a pouch. In certain embodiments, the swaddling can further include a blanket.

In addition, the swaddle can be produced from various materials that will not gather at the infant's neck, can be produced in various dimensions to accommodate infants of various sizes, can be made of various colors such as a pink or a blue color to identify the sex of the infant, can simulate a "womb-like" environment that is less traumatic on the infant, can keep the infant better positioned so the infant is less likely to turn, suffocate, and reduces the risk of SIDS, can provide breathability so that the infant does not overheat, can provide a pressure around the infant which is imperative for drug-exposed infants, and is cost effective from both a consumer's and manufacturer's point of view.

Not necessarily all such advantages may be achieved in accordance with any particular embodiment. Thus, the swaddling may be embodied or carried out in a manner that achieves or optimizes one advantage or group of advantages as taught herein without necessarily achieving other advantages as may be taught or suggested herein.

In at least one embodiment, the swaddling comprises a pouch. The swaddling can have one, some, or all of the following properties. The pouch can comprise an inner surface and an outer surface. The pouch can comprise a lower end. The lower end can be opened and closed to allow a diaper to be easily removed and replaced or to take a rectal temperature.

In various embodiments, the swaddling can further comprise a blanket. The foregoing swaddling can have one, some, or all of the following properties, as well as properties described elsewhere in this disclosure. The blanket can comprise an inner surface and an outer surface. The inner surface can comprise a pouch attachment area. The pouch attachment area can be marked. The pouch attachment area can comprise a first side and a second side. A first blanket flap can extend laterally from the first side of the pouch attachment area. A second blanket flap can extend laterally from the second side of the pouch attachment area. The first blanket flap can have a lateral length that is greater than the lateral length of the second blanket flap. The outer surface of the pouch can be fixed to the blanket. The outer surface of the pouch can be removably attached to the inner surface of the blanket. The outer surface of the pouch can be removably attached to the pouch attachment area of the blanket.

A method of using a swaddling is also disclosed. In at least one embodiment, the method comprises wrapping a first blanket flap and a second blanket flap around a pouch holding an infant. In various embodiments, the foregoing method has one, some, or all of the following properties. To utilize the swaddling, the second blanket flap is initially wrapped around the outer surface of the pouch and is attached thereto by an attachment means. After the second blanket flap is attached, the first blanket flap is wrapped around the second blanket flap and is attached thereto by the attachment means.

In at least one embodiment, infant swaddling comprises a blanket comprising a laterally extending first blanket flap and a laterally extending second blanket flap, and further comprising a first blanket surface comprising one or more pouch attachments, and a second blanket surface opposite the first blanket surface. The swaddling also comprises a pouch comprising a laterally extending first pouch flap and a laterally extending second pouch flap, and further comprising a first pouch surface comprising one or more first attachments near a side of the first pouch surface, the one or more first attachments extending vertically downward from an upper portion of the first pouch surface that, in use, is near the infant's head, neck, or upper torso toward a lower portion of the first pouch surface that, in use, is lower than the upper portion and near the infant's feet, and a lower attachment that, in use, is lower than the one or more first attachments, and a second pouch surface opposite the first surface comprising a plurality of second attachments that are recloseable with and complementary with the one or more first attachments and with the lower attachment and one or more blanket attachments complementary with the one or more pouch attachments, at least one of the blanket attachments being recloseable with at least one of the pouch attachments.

The foregoing swaddling can have one, some, or all of the following properties, as well as properties described elsewhere in this disclosure. The blanket can comprise a retainer for retaining the second blanket flap in a position when the blanket is in use on the infant. Each of the plurality of second attachments can be spaced laterally along the second pouch surface and extend vertically downward from the upper portion toward the lower portion. In use, the pouch can be configured such that the infant is placed on the first pouch surface, the one or more first attachments are configured to be recloseably attached to at least one of the plurality of second attachments such that the pouch is recloseably secured around the infant, the lower portion of the first pouch surface is configured to be gathered at the lower portion of the infant's body, the lower attachment is configured to recloseably attach to one of the plurality of second attachments, the first blanket flap is configured to be wrapped over the front of the infant, and the second blanket flap is configured to be wrapped over the first blanket flap. In use, the second blanket flap can be retained with the retainer. The retainer can comprise an elastic loop fixed to the second blanket surface and the second blanket flap can pass through the loop, which thereby retains the second blanket flap. At least one of the pouch attachments can be configured in use to be near the front of the infant and near the infant's head or neck. The one or more first attachments and the lower attachment can comprise hook or loop fabric. The one or more first attachments and the lower attachment can comprise tabs of hook or loop fabric. The lower attachment can be laterally offset from the one or more first attachments. The plurality of second attachments can comprise hook or loop fabric. The plurality of second attachments can comprise strips of hook or loop fabric. The one or more pouch attachments and the one or more blanket attachments can comprise tabs of hook or loop fabric.

In at least one embodiment, infant swaddling comprises a pouch configured to open to lay flat, the pouch comprising an outward-facing surface that, when an infant is placed on the open pouch, faces away from the infant and an inner-facing surface that, when an infant is placed on the open pouch, faces toward the infant. The pouch comprises an upper portion with an upper edge that, when in use, is proximal the infant's head region, the upper portion comprising an upper section that, when in use, is near the nape of the infant's neck, and a lower section, at least a part of which, when in use, is the under the infant's chin region. The pouch also comprises a lower portion spaced apart from the upper portion that, when in use, is proximal the infant's feet, a laterally extending first flap integral with the upper portion and lower portion, the inner-facing surface of the first flap comprising one or more first attachments extending vertically downward from the upper portion toward the lower portion, and a laterally extending second flap integral with the upper portion and lower portion. The outward-facing surface comprises one or more second attachments that are recloseable with and complementary with the one or more first attachments and a retainer configured to receive and recloseably retain the lower portion of the pouch when in use.

The foregoing swaddling can have one, some, or all of the following properties, as well as properties described elsewhere in this disclosure. At least a part of the upper edge of the lower section can be lower than at least a part of the upper edge of the upper section when the pouch is open. The upper section can be between the lower section and a sloped section that forms part of an edge of the first flap. The one or more first attachments can comprise a plurality of hook or loop fabric elements. The one or more second attachments can comprise a plurality of hook or loop fabric elements. At least one of the hook and loop fabric elements of the one or more second attachments can have a surface area at least about 8 times larger than at least one of the hook or loop fabric elements of the one or more first attachments. The retainer can be an elastic loop.

In at least one embodiment, infant swaddling comprises a sheet configured to open to lay flat. The sheet comprises an outward-facing surface that, when an infant is placed on the open sheet, faces away from the infant, an inner-facing surface that, when an infant is placed on the open sheet, faces toward the infant, a first side, and a second side opposite the first side. The sheet also comprises an upper portion that, when in use, is near the infant's head region, the upper portion comprising an upper section that, when in use, is near the nape of the infant's neck, a first lower section comprising an upper edge that slopes downward toward a side edge of the first side, and a second lower section comprising an upper edge that slopes downward toward a side edge of the second side. At least a part of the first lower section or at least a part of the second lower section, when in use, is under the infant's chin region. The sheet also comprises a lower portion spaced apart from the upper portion that, when in use, is proximal the infant's feet; a laterally extending first flap integral with the upper portion and lower portion, the inner-facing surface of the first flap comprising one or more first attachments extending vertically downward from the upper portion toward the lower portion; and a laterally extending second flap integral with the upper portion and lower portion, the outward-facing surface of the second flap comprising one or more second attachments that are recloseable with and complementary with the one or more first attachments. The outward-facing surface comprises a retainer configured to receive and recloseably retain the lower portion of the pouch when in use.

The foregoing swaddling can have one, some, or all of the following properties, as well as properties described elsewhere in this disclosure. The one or more first attachments can comprise a plurality of hook or loop fabric elements and the one or more second attachments can comprise a plurality of hook or loop fabric elements. At least one of the hook and loop fabric elements of the one or more second attachments can have a surface area at least about 8 times larger than at least one of the hook or loop fabric elements of the one or more first attachments. A junction between an upper edge of the first sloped section and the side edge of the first side can comprise a fillet. The one or more first attachments can comprise one or more hook or loop fabric elements near the fillet. The retainer can be an elastic loop. The inner-facing surface can be configured such that, when an infant is placed on the open sheet, the infant is substantially vertically centered on the open sheet.

The swaddling of this disclosure can comprise any of the foregoing embodiments and also can include constructions of the following examples.

BRIEF DESCRIPTION OF THE DRAWINGS

Example embodiments that implement the various features of the disclosed swaddling and associated methods will now be described with reference to the drawings. The drawings and associated descriptions are provided to illustrate embodiments and not to limit the scope of the disclosure.

Throughout the drawings, reference numbers are frequently reused to indicate correspondence between referenced (or similar) elements. Nevertheless, the use of different numbers to indicate certain elements does not necessarily indicate that these elements are dissimilar or do not correspond with each other.

DETAILED DESCRIPTION

The following detailed description discloses swaddling and corresponding methods of use. It should be appreciated that the embodiments discussed below represent examples of suitable configurations, and the components can be resized and/or reconfigured as desired to produce a desired embodiment or effect. For example, the figures may show certain features on a left side or a right side of the swaddling. These features can be reversed so that features are placed on the opposite side of the swaddling. Such modifications are within the scope of the invention.

Swaddling

The swaddling 10 comprises a pouch 70. "Pouch" is a broad term and includes, without limitation, structures that, in use on an infant, generally resemble bags, pockets, sacks, tubes, or cylinders. The term "pouch" further contemplates that such structures can be closed, open, or reclosable at the lower end. "Recloseable" means that the structure can be quickly and reversibly closed and opened during normal use without requiring disassembly and reassembly, destructive interference, or application of a substantial external force sufficient to damage the structure. In certain embodiments, the swaddling 10 can further comprise a blanket 12. "Blanket" is a broad term and is to be given its ordinary and customary meaning to a person of ordinary skill in the art (that is, it is not to be limited to a special or customized meaning). It should be understood, however, that the blanket 12 is optional and the embodiments discussed in this disclosure can be modified for use without a blanket, for example, by omitting any described attachment between the pouch 70 and the blanket 12.

As used herein, and unless otherwise indicated, the term "lower" refers to a location that, in use, is nearer to the feet or bottom of an infant; the term "upper" refers to a location that, in use, is nearer to the head or neck of an infant; the term "front" refers to a location that, in use, is nearer to the belly of an infant; the term "back" refers to a location that, in use, is nearer to the spinal region of an infant.

Blanket

Figure 2:
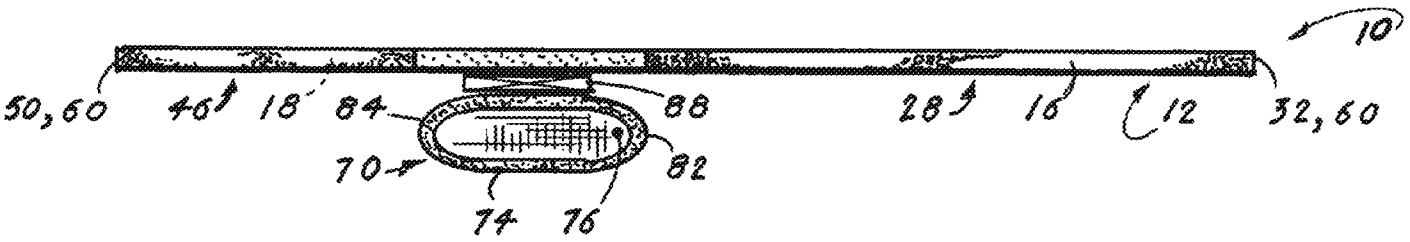
FIG. 2 is a top plan view of the swaddling of FIG. 1.
Figure 1:
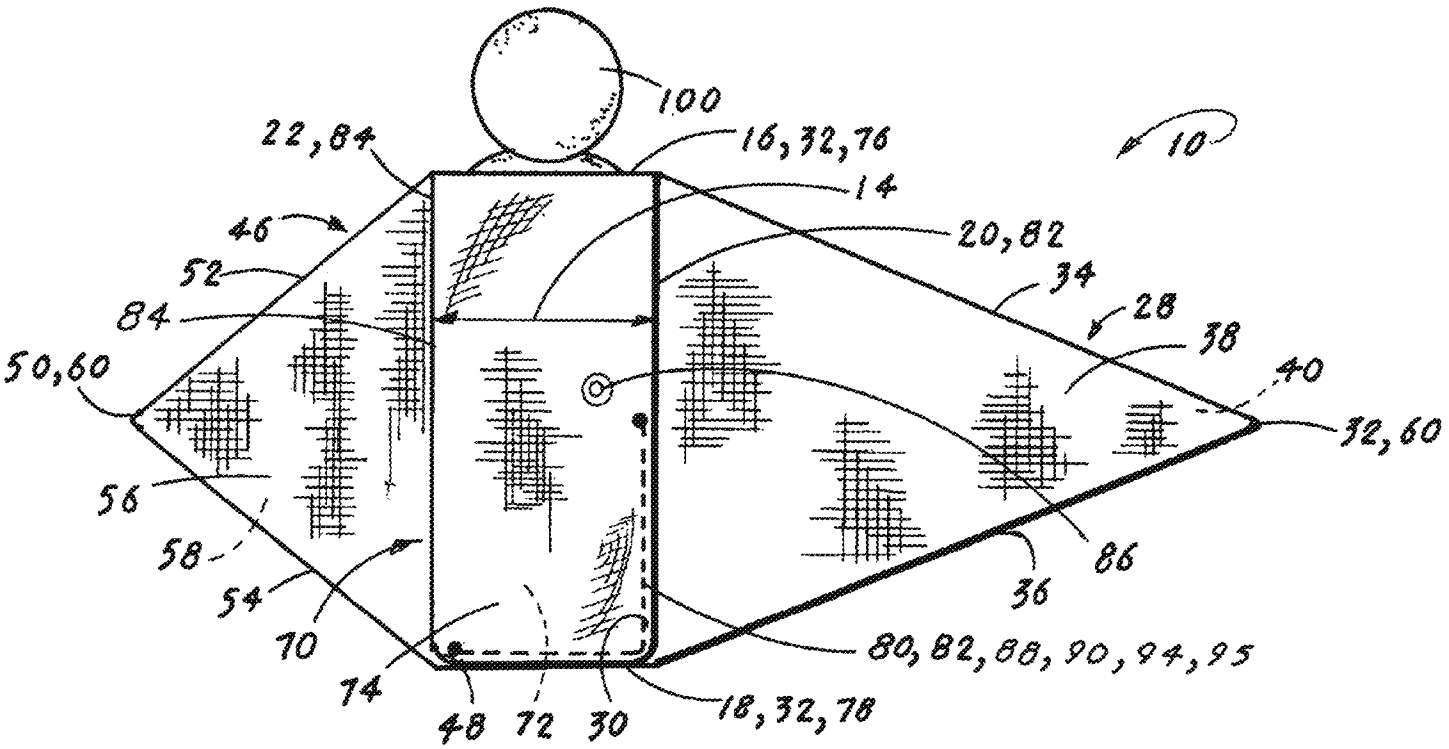
FIG. 1 is a front elevational view of swaddling showing a pouch attached between a first blanket flap and a second blanket flap, and with an infant inserted into the pouch.

With reference first to FIGS. 1 and 2, the blanket 12 includes a first blanket flap 28 and a second blanket flap 46. "Flap" is a broad term and is to be given its ordinary and customary meaning to a person of ordinary skill in the art (that is, it is not to be limited to a special or customized meaning) and includes, without limitation, an undemarcated portion of the blanket 12. The blanket can be appropriately sized for different infant uses. Small blankets can be used with premature infants. Larger blankets can be used with newborn infants or young infants. The blanket 12 can be made of a variety of materials. Desirably, the materials are selected to be soft, durable, hypoallergenic, and/or easily launderable with a standard washing machine and dryer. Example materials for can include wool, cotton, and nylon. A particularly suitable material for warmer environments comprises a lightweight bamboo and spandex blend. A particularly suitable material for colder environments comprises a bamboo, cotton, and spandex blend. Use of bamboo fibers is desirable because it makes the resulting blanket soft to the touch.

Figure 3:
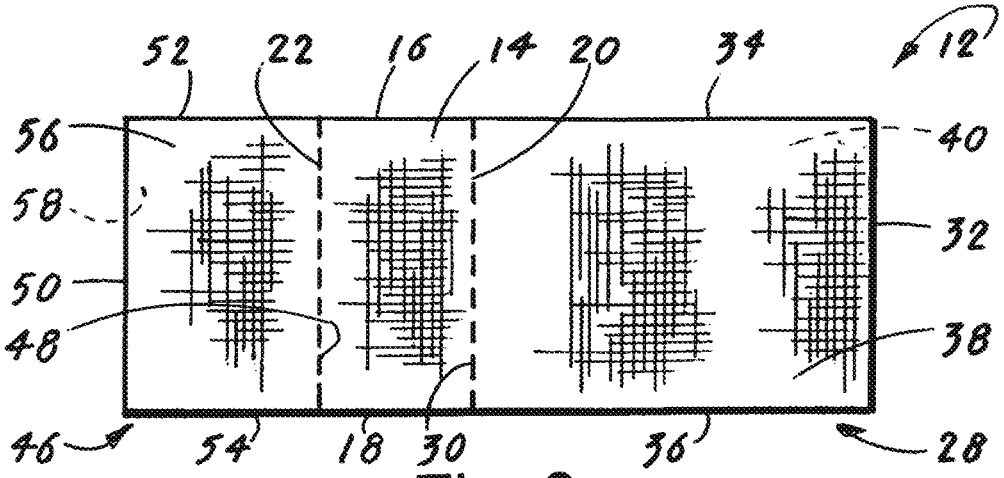
FIG. 3 is an elevational view of a blanket having the upper and lower edges of the first and second blanket flaps in alignment with the respective upper and lower edges of the blanket.
Figure 4:
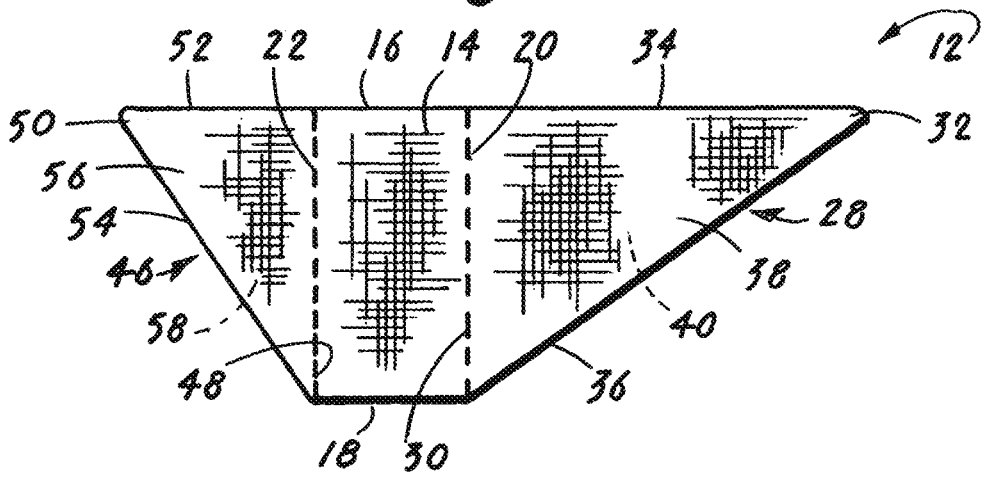
FIG. 4 is an elevational view of a blanket that has the upper edges of the first and second blanket flaps in alignment with the respective upper edge of the blanket, and the lower edges of the first and second blanket flaps angled upward.
Figure 5:
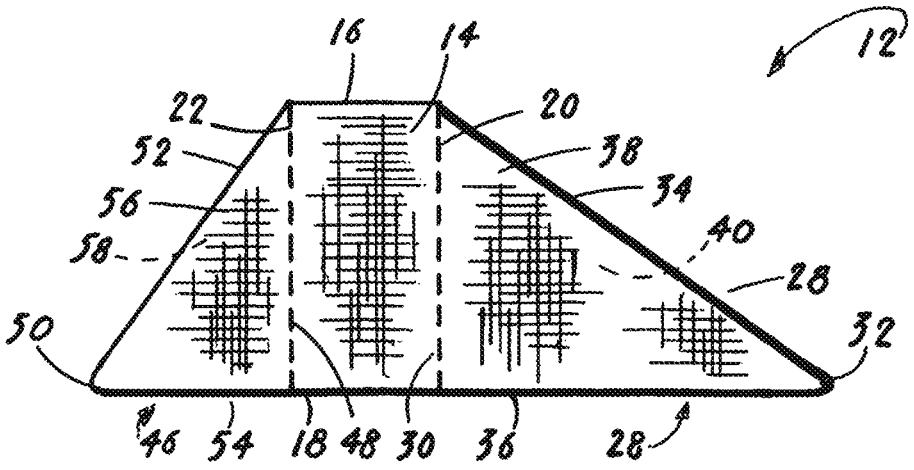
FIG. 5 is an elevational view of a blanket having the upper edge of the first and second blanket flaps angled downward, and with the lower edges of the first and second blanket flaps in alignment with the respective lower edges of the blanket.

As shown in FIGS. 3-5, the blanket 12 includes a pouch attachment area 14, comprising an upper edge 16, a lower edge 18, a first pouch border attachment mark 20 on the same side as first blanket flap 28, and a second pouch border attachment mark 22 on the same said as second blanket flap 46. The two border attachment marks 20, 22 are shown in broken lines, in FIGS. 3-5, and outline the area 14 in which area the pouch 70 is attached. In certain embodiments, one or both attachment marks 20, 22 can be visibly indicated on the blanket 12. Alternatively, the attachment marks are not visibly indicated on the blanket 12.

With reference to FIGS. 1-5, the first blanket flap 28 further comprises an inner edge 30 that is integral with the first pouch border attachment mark 20, an outer edge 32, an upper edge 34, a lower edge 36, an inner surface 38 facing pouch 70, and an outer surface 40 opposite the inner surface 38. Likewise, the second blanket flap 46 further comprises an inner edge 48 that is integral with the second pouch border attachment mark 22, an outer edge 50, an upper edge 52, a lower edge 54, an inner surface 56 facing pouch 70, and an outer surface 58 opposite the inner surface 56.

In certain configurations, and as shown in FIGS. 1-5, the lateral length of the second blanket flap 46, as measured from the second pouch border attachment mark 22, is less than the lateral length of the first blanket flap 28, as measured from the first pouch border attachment mark 20. "Lateral length" refers to a horizontal distance that, in use, extends generally perpendicular to the head-to-toe vertical positioning of the infant 100. In alternative configurations (not shown), the lateral length of the second blanket flap 46 is substantially the same as the lateral length of the first blanket flap 28.

The first blanket flap 28 and second blanket flap 46 of the blanket 12 can be configured in several different shapes.

In a first example shape, as shown in FIG. 1, the upper edge 34 of the first blanket flap 28 and the upper edge 52 of the second blanket flap 46 are angled downward from the upper edge 16 of the pouch attachment area 14, each in opposite directions. In addition, the lower edge 36 of the first blanket flap 28 and the lower edge 54 of second blanket flap 46 are angled upward from the lower edge 18 of the pouch attachment area 14, each in opposite directions. The first blanket flap 28 and the second blanket flap 46 respectively terminate at outer edge 32 and outer edge 50, each of which represents an apex 60 of a lateral axis that is substantially centered between the upper edge 16 and the lower edge 18 of the pouch attachment area 14.

In a second example shape, as shown in FIG. 3, the upper edges 34, 52 of the first and second blanket flaps 28, 46 are in a line with the upper edge 16 of the pouch attachment area 14, and the lower edges 36, 54 of the first and second blanket flaps 28, 46 are in a line with the lower edge 18 of the pouch attachment area 14.

In a third example shape, as shown in FIG. 4, the upper edges 34, 52 of the first and second blanket flaps 28, 46 are in a line with the upper edge 16 of the pouch attachment area 14. The lower edges 36, 54 of the first and second blanket flaps 28, 46 are angled upward from the lower edge 18 of the pouch attachment area 14, each in opposite directions. The first and second blanket flaps 28, 46 respectively terminate at an outer edge 32, 50. Each of the outer edges 32, 50 represents an apex 62 of a lateral axis that is disposed along the upper edge 16 of the pouch attachment area 14.

In a fourth example shape, as shown in FIG. 5, the upper edges 34, 52 of the first and second blanket flaps 28, 46 are angled downward from the upper edge 16 of the pouch attachment area 14, each in opposite directions. The lower edges 36, 54 of the first and second blanket flaps 28, 46 are in a line with the lower edge 18 of the pouch attachment area 14. The first and second blanket flaps 28, 46 respectively terminate at an outer edge 32, 50. Each of the outer edges 32, 50 represents an apex 62 of a lateral axis that is disposed along the lower edge 18 of the pouch attachment area 14.

Additional suitable shapes for the blanket are also discussed in this disclosure.

The blanket 12 is attached to pouch 70 at attachment 88. In certain configurations, attachment 88 represents a single attachment. In other configurations, attachment 88 represents multiple attachments. Attachment 88 is also described below in more detail.

Pouch

As shown in FIG. 1, the pouch is dimensioned to allow an infant to be placed into the pouch 70, with the infant's arms located internally within the pouch 70 or with the infant's arms located externally to the pouch 70. The pouch can be appropriately sized for different infant uses. Small pouches can be used with premature infants. Larger pouches can be used with newborn infants or young infants.

In use, the pouch 70 comprises a first side 82 proximal the first blanket flap 28 and a second side 84 proximal the second blanket flap 46. The pouch further comprises an inner section 72 (disposed in use near the back of the infant 100) near attachment 88 and an outer section 74 (disposed in use near the chest of the infant 100) opposite the inner section 72. The inner section 72 is dimensioned to be attached to an area bordered by the first and second pouch border attachment marks 20, 22 on the blanket 12. The pouch 70 has a length that preferably places an open upper end 76 of the pouch adjacent to the chest area of an infant. The pouch 70 further comprises a lower end 78 opposite the open upper end 76. The lower end 78 of the pouch 70 is preferably located adjacent to the lower edge 18 of the blanket 12. As shown in FIG. 1, the lower edges 36, 54 of first and second blanket flaps 28, 46 can be located in substantial alignment with the lower end 18. Alternatively, the lower edges 36, 54 of the first and second blanket flaps 28, 46 can extend above the lower end 78 of the pouch 70 (not shown).

Figure 7:
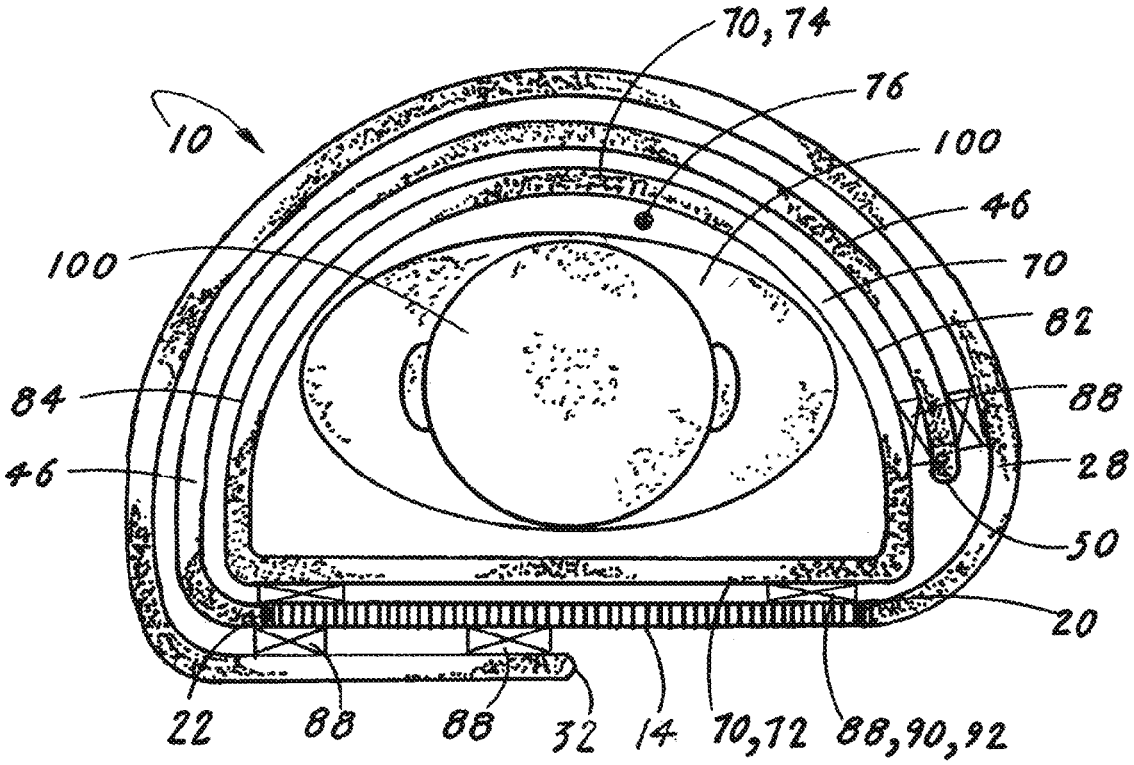
FIG. 7 is a top plan view of the swaddling showing the first and second blanket flaps wrapped around the pouch.

The pouch 70 can be made of a variety of suitable materials. Desirably, the pouch 70 is made of a resilient soft material that maintains a comfortable pressure on the infant 100 placed into the pouch 70, as shown in FIG. 7. Desirably, the materials are selected to be soft, durable, hypoallergenic, and/or easily launderable with a standard washing machine and dryer. Example materials for can include stretch cotton, stretch polyester, stretch denim, stretch vinyl, and stretch velvet. A particularly suitable material comprises 92% polyester and 8% spandex jersey fabric. This material was found to be moisture wicking, which can reduce excess heat and thus the possibility of a swaddled infant overheating.

In at least one embodiment, the blanket 12 is fixed to the pouch 70 at attachment 88. As used herein, the term "fixed" means that the attached components are attached during normal use such that disassembly, destructive interference, or a substantial external force sufficient to damage the components is needed in order to separate them. For example, the blanket 12 can be fixed to the pouch 70 by a sewn seam, sewn stitches, adhesive, glue, and the like.

In certain configurations, the blanket 12 can be removably attached to the pouch 70 at attachment 88. The term "removably attached" means that the attached components can be quickly and reversibly attached and detached during normal use without requiring disassembly and reassembly, destructive interference, or application of a substantial external force sufficient to damage the components. The inner section 72 of the pouch 70 can be attached to the pouch attachment area 14 by means for removably attaching the pouch 70 to the swaddling blanket 12, such as hook and loop fasteners, male and female detents, buttons, zippers, strings, ties, and equivalents thereof. In at least one embodiment, the inner section 72 of the pouch 70 is attached to the pouch attachment area 14 by hook and loop fasteners.

In at least one embodiment, the pouch 70 is recloseable. In such embodiments, a first flap portion of the pouch 70 is configured to interface with a second flap portion 80 of the pouch 70 such that the first flap portion and the second flap portion can be quickly and reversibly joined and separated during normal use without requiring disassembly and reassembly, destructive interference, or application of a substantial external force sufficient to damage the flap portions. As demonstrated in FIGS. 1 and 6, the interface can extend partially along the pouch's first side 82, the pouch's second side 84, the lower end 78, or along a combination thereof (such as along the first side 82 and lower end 78, along the second side 84 and the lower end 78, along the first side 82 and second side 84, or along the first side 82, lower end 78, and second side 84). The recloseable configuration can advantageously allow the pouch 70 to be easily opened to allow a diaper to be changed or to take a rectal temperature. Suitable means for recloseably attaching the pouch 70 flap portions include hook and loop fasteners, male and female detents, a zipper, one or more buttons, strings, ties, and equivalents thereof.

Infant Head Cover

Figure 6:
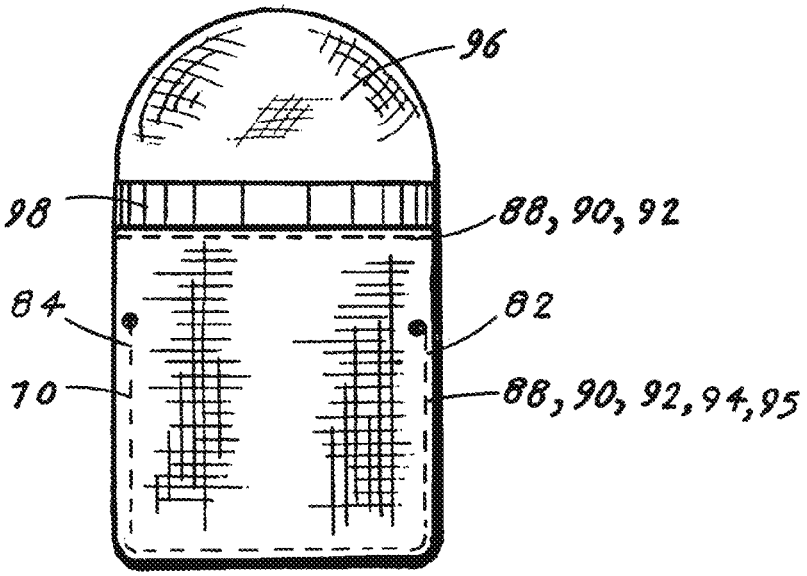
FIG. 6 is a front elevational view of a pouch that includes a removably attached infant head cover.

As shown in FIG. 6, the swaddling 10 can also comprise an infant head cover 96. In certain embodiments, the infant head cover 96 can be sized and configured to apply a comforting pressure around the infant's head. The swaddling can be made of a variety of materials. Desirably, the infant head cover 96 is made of a resilient soft material that maintains a comfortable pressure on the infant 100 placed into the pouch 70. Desirably, the materials are selected to be soft, durable, hypoallergenic, and/or easily launderable with a standard washing machine and dryer. Example materials for can include stretch cotton, stretch polyester, stretch denim, stretch vinyl, and stretch velvet. A particularly suitable material comprises 92% polyester and 8% spandex jersey fabric. This material was found to be moisture wicking, which can reduce excess heat and thus the possibility of a swaddled infant overheating.

The cover 96 can extend from the open upper end 76 located on the pouch 70 or from the upper edge 16 of the blanket 12. Suitable means for removably attaching the cover 96 to the pouch 70 or the blanket 12 include hook and loop fasteners, male and female detents, a zipper, one or more buttons, strings, ties, and equivalents thereof. The head cover 96 can also comprise a low-resistance elastic band 98 that provides additional security to the cover 96.

Method of Using the Blanket and Pouch Combination

An example method of using the swaddling 10 is next described. In general, as shown in FIG. 7, the second blanket flap 46 is folded over the pouch 20 holding infant 100 prior to folding the first blanket flap 28. More specifically, the second blanket flap 46 commencing from the second pouch border attachment mark 22 is wrapped sequentially around the pouch's second side 84 and the outer section 74. In certain configurations, means for removably attaching the outer edge 50 of the second blanket flap 46 to the first side 82 of the pouch 70 can provide a secure but easily removable connection between the blanket 12 and pouch 70. Suitable means for removable attachment include hook and loop fasteners, male and female detents, one or more buttons, strings, ties, and equivalents thereof.

Next, the first blanket flap 28 commencing from the first pouch border attachment mark 20 is wrapped sequentially around the second blanket flap 46 and around the outer and second side section 74, 84 of the pouch 70. In certain configurations, means for removably attaching the outer edge 32 of the first blanket flap 28 to the second blanket flap 46 can provide a secure but easily removable connection between the first blanket flap 28 and the second blanket flap 46. Suitable means for removable attachment include hook and loop fasteners, male and female detents, one or more buttons, strings, ties, and equivalents thereof.

Additional Swaddling Configurations

FIGS. 8A-8D, FIGS. 9A-9D, FIGS. 10A-10B, and FIGS. 11A-11B show components of other example swaddling. Each of the respective embodiments of FIG. 8A-8D, FIGS. 9A-9D, FIGS. 10A-10B, and FIGS. 11A-11B is drawn so that the relative sizing of the components can be appreciated. Nevertheless, other practicable sizing can be used. The following description is directed to those components as well as methods for assembling or otherwise using the swaddling.

Again, it should be appreciated that the embodiments of FIGS. 8A-8D, FIGS. 9A-9D, FIGS. 10A-10B, and FIGS. 11A-11B represent examples of suitable configurations, and the components can be resized and/or reconfigured as desired to produce a desired embodiment or effect. For example, the figures may show certain features on a left side or a right side of the swaddling. These features can be reversed in certain embodiments so that features are placed on the opposite side of the swaddling. In addition, these embodiments can incorporate features discussed elsewhere in this disclosure but not specifically repeated in this subsection, such as an infant head cover.

Figure 8A:
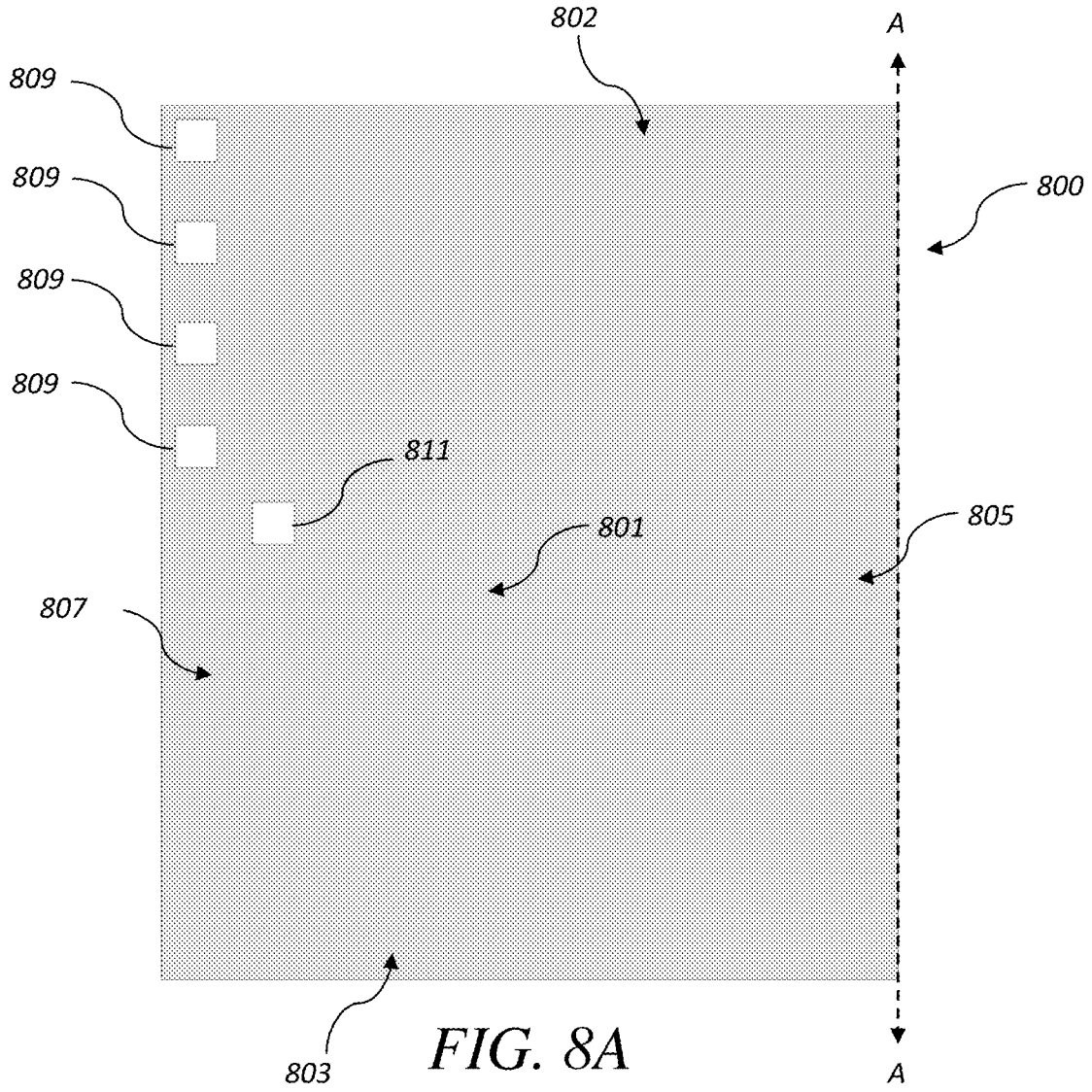
FIG. 8A is an elevational view of a first surface of another example pouch in an unwrapped configuration.
Figure 8B:
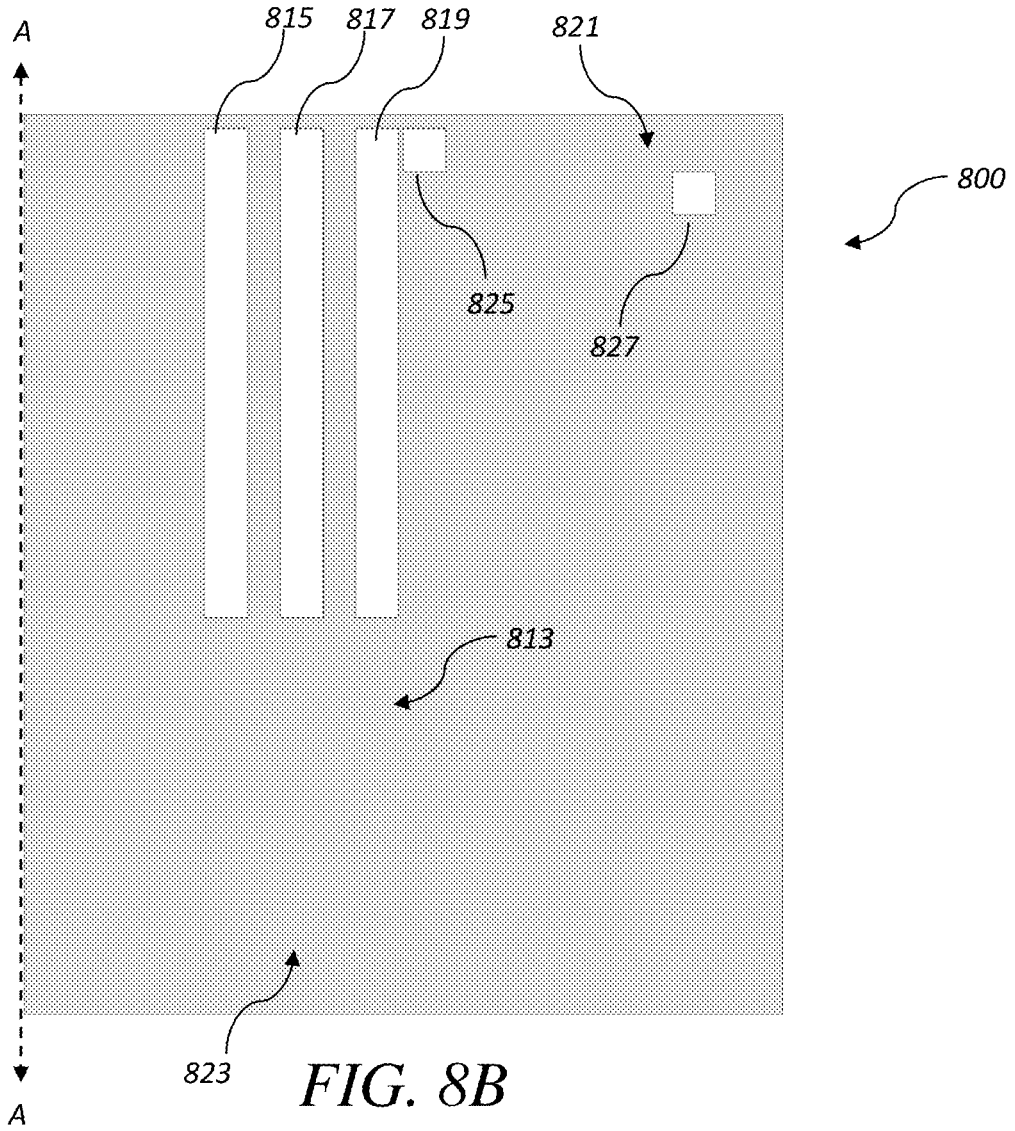
FIG. 8B is an elevational view of a second surface of a pouch in an unwrapped configuration, the second surface being opposite the first surface depicted in FIG. 8A.

An example pouch 800 is shown in FIGS. 8A and 8B. As discussed above, pouch 800 can be made of a resilient soft material that maintains a comfortable pressure on a baby placed into the pouch 800. Desirably, the material is selected to be soft, durable, hypoallergenic, and/or easily launderable with a standard washing machine and dryer. Example materials for can include stretch cotton, stretch polyester, stretch denim, stretch vinyl, and stretch velvet. A particularly suitable material comprises 92% polyester and 8% spandex jersey fabric. This material was found to be moisture wicking, which can reduce excess heat and thus the possibility of a swaddled infant overheating.

Although the embodiment is shown without a head cover, a head cover can be incorporated, if desired, as discussed herein. In addition, although the embodiment is shown with a blanket, the blanket can be omitted, if desired.

In at least one example method of positioning the pouch 800 on a baby, the first surface 801 of FIG. 8A contacts the baby. For example, the baby can be placed on the first surface 801 such that the baby is approximately centered along a conceptual vertical centerline or placed generally offset (e.g., left-of-center) from the conceptual vertical centerline on the first surface 801. The baby's back can contact the first surface 801, and the baby's chest can face away from the first surface 801. The baby's head and neck are proximal the top portion 802 of the first surface 801 and, preferably, extend beyond the top portion 801. The baby's feet extend toward the lower portion 803 of the first surface 801. To use the pouch 800, a first side 805 of the first surface 801 is folded over the baby's chest. A second side 807 of the first surface 801 is folded over the first side 805.

FIG. 8B shows a second surface 813 of the pouch 800 opposite the first surface 801 depicted in FIG. 8A. Line A-A shows the axis of rotation from FIG. 8A to FIG. 8B.

As discussed below, the configuration of FIGS. 8A and 8B can be advantageous because the configuration allows the pouch 800 size to be adjusted to accommodate an infant's growth to accommodate different sized infants.

Referring again to FIG. 8A, the first surface 801 comprises first attachment 809. As used herein, "attachment" broadly refers to a single mechanism or plural mechanisms for attaching. In this example, the attachment 809 comprises a plurality of tabs of hook fabric and, more specifically, four tabs of hook fabric. However, a variety of suitable means for attaching 809 can be used. For example, the attachment 809 can comprise one or more of the following elements: loop fabric (plural rounds or tabs, a single strip, or other suitable configurations), hook fabric (plural rounds or tabs, a single strip, or other suitable configurations), one or more male halves of a snap fastener, one or more female halves of a snap fastener, a half of a zipper, one or more buttons, one or more button holes or rings, one or more strings, one or more ties, and equivalents thereof.

Referring now to FIG. 8B, the second surface 813 comprises a plurality of second attachments 815, 817, 819 that are complementary with the first attachment 809. The second attachments 815, 817, 819 are spaced laterally along the top portion 817 of the second surface 813. In this example, the plurality of second attachments 815, 817, 819 are strips of loop fabric. Loop fabric is complementary with the hook fabric of the first attachment 809. The compliance of other fastener types is generally known in the art.

After the second side 807 of the first surface 801 is folded over the first side 805, as shown in FIG. 8A, first attachment 809 will face the complementary second attachments 815, 817, 819 shown in FIG. 8B. First attachment 809 (FIG. 8A) can be removably attached to second attachment 815 (FIG. 8B) to accommodate a large infant. First attachment 809 (FIG. 8A) can be removably attached to second attachment 817 (FIG. 8B) to accommodate a medium-sized infant. First attachment 809 (FIG. 8A) can be removably attached to second attachment 819 (FIG. 8B) to accommodate a small infant. It is also contemplated that different tabs of first attachment 811 (FIG. 8A) can attach to different strips of second attachments 815, 817, 819 (FIG. 8B). Certain embodiments include the realization that multiple second attachments spaced laterally along the second surface 813 can advantageously improve the adjustability of the pouch 800 size.

The example embodiment comprises three second attachments 815, 817, 819. Nevertheless, more or fewer second attachments can be used. For example, one or more additional second attachments can be offset from (e.g., placed to the left of) second attachment 815 to accommodate even larger infants. One or more additional second attachments can be offset from (e.g., placed to the right of) second attachment 819 to accommodate even smaller infants. Fewer than three second attachments can be used to provide less adjustability in sizing. A single second attachment (e.g., only second attachment 817) also can be used in certain embodiments. It should be appreciated that, although the configuration of FIGS. 8A and 8B may be preferred in certain embodiments, other configurations, including non-adjustable configurations and other variations, may be utilized in other embodiments as may be desired.

The configuration of FIGS. 8A and 8B also can be advantageous because the configuration allows the pouch 800 to be easily opened to allow a diaper to be changed or to take a rectal temperature.

For example, when first attachment 809 (FIG. 8A) is removably attached to one or more of the second attachments 815, 817, 819 (FIG. 8B), the lower portion 823 (FIG. 8B) of the outward-facing second surface 813 (FIG. 8B) is open, allowing access to the infant near the infant's feet or bottom. The size of the opening can be further increased by detaching a bottom one or two tabs of first attachment 809 (FIG. 8A).

Closing access through the lower portion 823 can be desirable to keep the infant's feet warm and/or to minimize movement of the infant's feet. If desired, to close access through the lower portion 823 (FIG. 8B), the lower portion 823 (FIG. 8B) can be rolled, bunched, or otherwise gathered to enclose the lower portion of the infant's body. Third attachment 811 (FIG. 8A) can be removably attached to one of the second attachments 815, 817, 819 (FIG. 8B), as desired, to retain the gathered lower portion 823 (FIG. 8B) in place. In the example embodiment of FIG. 8A, third attachment 811 is laterally offset from first attachment 809. This offset configuration can be desirable because it creates a tighter fit for the pouch proximal the infant's feet. Nevertheless, third attachment 811 can be inline with first attachment 809, if desired. In at least one embodiment, third attachment 811 can be attached to a second attachment (e.g., second attachment 817 or 819) to the right of whichever second attachment (e.g., second attachment 815 or 817) is removably attached to first attachment 809. This configuration creates an even tighter fit for the pouch 800 proximal the infant's feet. In this example, third attachment 811 (FIG. 8A) comprises a tab of hook fabric. Nevertheless, another attachment that is complementary with the second attachments 815, 817, 819 (FIG. 8B) can also be used. Alternatively, a complementary fourth attachment (not shown) can be incorporated on the second surface 813 (FIG. 8B) of the pouch 800 to allow removable attachment with the third attachment 811 (FIG. 8A).

Figure 8C:
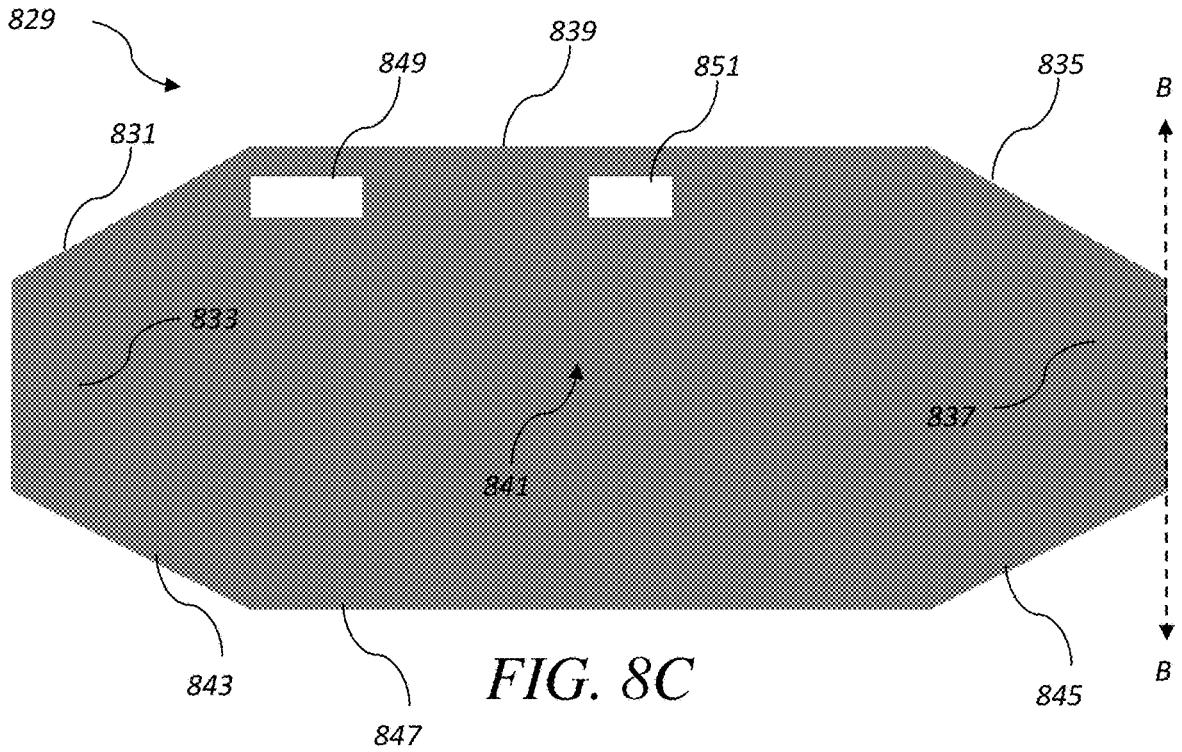
FIG. 8C is an elevational view of a first surface of a blanket in an unwrapped configuration, the blanket being complementary with the pouch of FIGS. 8A and 8B.
Figure 8D:
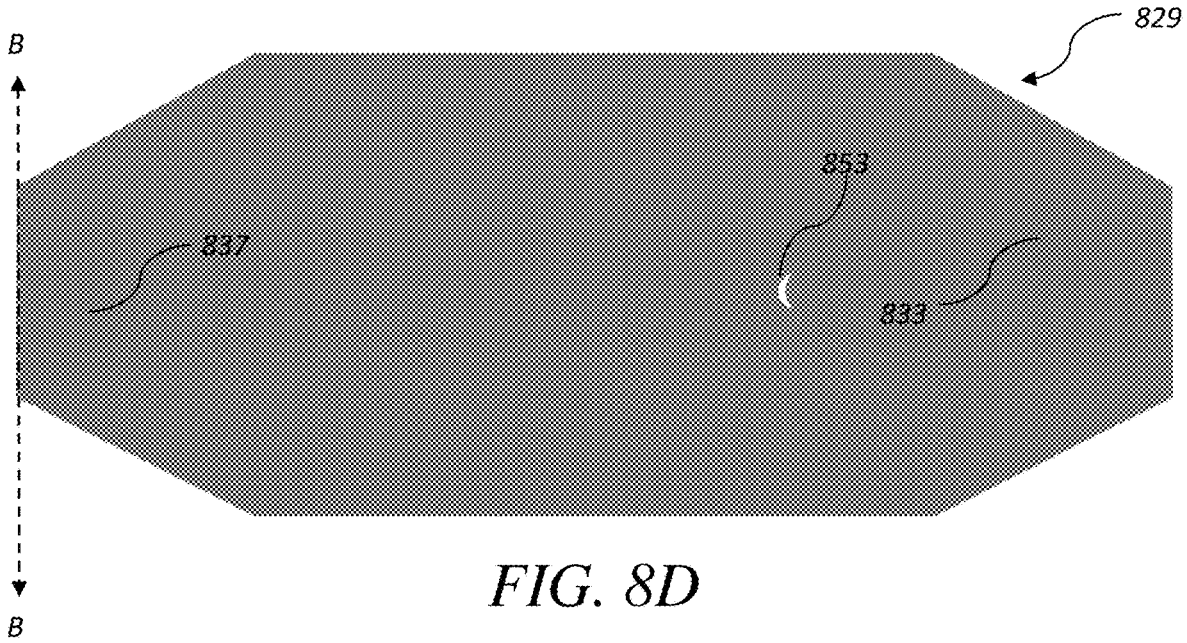
FIG. 8D is an elevational view of a second surface of a blanket, the second surface being opposite the surface depicted in FIG. 8C.

To complete a swaddling, a blanket can be attached to the pouch 800. An example blanket 829 is shown in FIGS. 8C and 8D. As discussed above, the blanket 829 can be made of a variety of materials. Desirably, the materials are selected to be soft, durable, hypoallergenic, and/or easily launderable with a standard washing machine and dryer. Example materials for can include wool, cotton, and nylon.

FIGS. 8C and 8D show yet another suitable shape for the blanket 829. In FIG. 8C, the upper edge 831 of the first blanket flap 833 and the upper edge 835 of the second blanket flap 837 are angled downward from the upper edge 839 of the pouch attachment area 841, each in opposite directions. In addition, the lower edge 843 of the first blanket flap 833 and the lower edge 845 of second blanket flap 837 are angled upward from the lower edge 847 of the pouch attachment area 841, each in opposite directions. Portions of the first blanket flap 833 and the second blanket flap 837 each form a generally trapezoidal shape, substantially centered around a conceptual lateral axis that is substantially centered between the upper edge 839 and the lower edge 847 of the pouch attachment area 841.

It should be appreciated that, although the shape of the blanket 829 shown in FIGS. 8C and 8D may be preferred in certain embodiments, other configurations may be utilized in other embodiments as may be desired. For example, the general shapes shown in FIGS. 1 and 3-5 are suitable and can be incorporated as desired.

FIG. 8C shows a first surface of the blanket 829. The first surface of the blanket 829 (FIG. 8C), in use, is an inward facing surface that faces the second surface 813 (FIG. 8B) (that is, the outward-facing surface) of the pouch 800 (FIG. 8B). The first surface of the blanket 829 comprises a pouch attachment area 841 where the pouch 800 (FIG. 8B) is attached to the blanket 829.

FIG. 8D shows a second surface of the blanket 829 opposite the first surface depicted in FIG. 8C. In use, the second surface of the blanket 829 faces outward. Line B-B shows the axis of rotation from FIG. 8C to FIG. 8D.

In the example embodiment of FIGS. 8C and 8D, the blanket 829 can be removably attached to the pouch (FIG. 8B). The pouch 800 (FIG. 8B) is placed in the pouch attachment area 841 (FIG. 8C). Attachment 849 (FIG. 8C) of the blanket 829 removably attaches to attachment 827 (FIG. 8B) of the pouch. Attachment 851 (FIG. 8C) of the blanket 829 removably attaches to attachment 825 (FIG. 8B) of the pouch. It can be desirable to position attachment 849 (FIG. 8C) and its complementary attachment 827 (FIG. 8B) near the front of the infant. This configuration can advantageously reduce movement of the blanket 829 in the area near the infant's neck and thereby reduce the possibility of unsafe bunching of the blanket 829 around the infant's neck or mouth. In the example of FIG. 8C, attachments 849, 851 are tabs of hook fabric. In the example of FIG. 8B, complementary attachments 825, 827 are tabs of loop fabric. However, any suitable attachment means can be used for attachments 849, 827 and 851, 825. Furthermore, more or fewer than two attachment pairs can be used to removably attach the blanket 829 (FIG. 8C) to the pouch 800 (FIG. 8B). For example, one attachment pair (e.g., attachment pair 849, 827) can be suitable. As another example, three or four attachment pairs may provide a more secure connection between the blanket 829 (FIG. 8C) and the pouch 800 (FIG. 8B) and/or minimize bunching of the blanket 829. It should be appreciated that, although the configuration of FIGS. 8B and 8C may be preferred in certain embodiments, other configurations may be utilized in other embodiments as may be desired.

The blanket 829 can be wrapped around the infant. In the embodiment of FIGS. 8B and 8C, the blanket 829 is sized so that it does not necessarily wrap multiple times around the infant. This configuration includes the realization that a blanket that does not wrap multiple times around the infant can be quickly wrapped while reducing the need to move the infant. Nevertheless, it should be appreciated that, although the configuration of FIGS. 8C and 8D may be preferred in certain embodiments, other configurations may be utilized in other embodiments as may be desired. For example, a fuller wrap as show in FIG. 7 can be incorporated as desired.

FIG. 8D shows the surface of the blanket 829 that faces outward when the blanket 829 is to be wrapped around the infant. In this example, first blanket flap 833 is draped or otherwise wrapped over the front of the infant. Second blanket flap 837 is wrapped such that it crosses over first blanket flap 833 on the infant. Second blanket flap 837 is bunched and passed through loop 851. Loop 851 holds second blanket flap 837 in place around the infant. In this example, loop 851 is an elastic loop that is sewn on the blanket 829 to fix it to the blanket 829. However a variety of different techniques can be used to hold second blanket flap 837 in place around the infant. For example, second blanket flap 837 and the outward facing surface of the blanket 829 can use suitable attachment means to hold the second blanket flap 837 in place around the infant. Numerous attachment means have been discussed above and are incorporated in this discussion by reference.

Figure 9A:
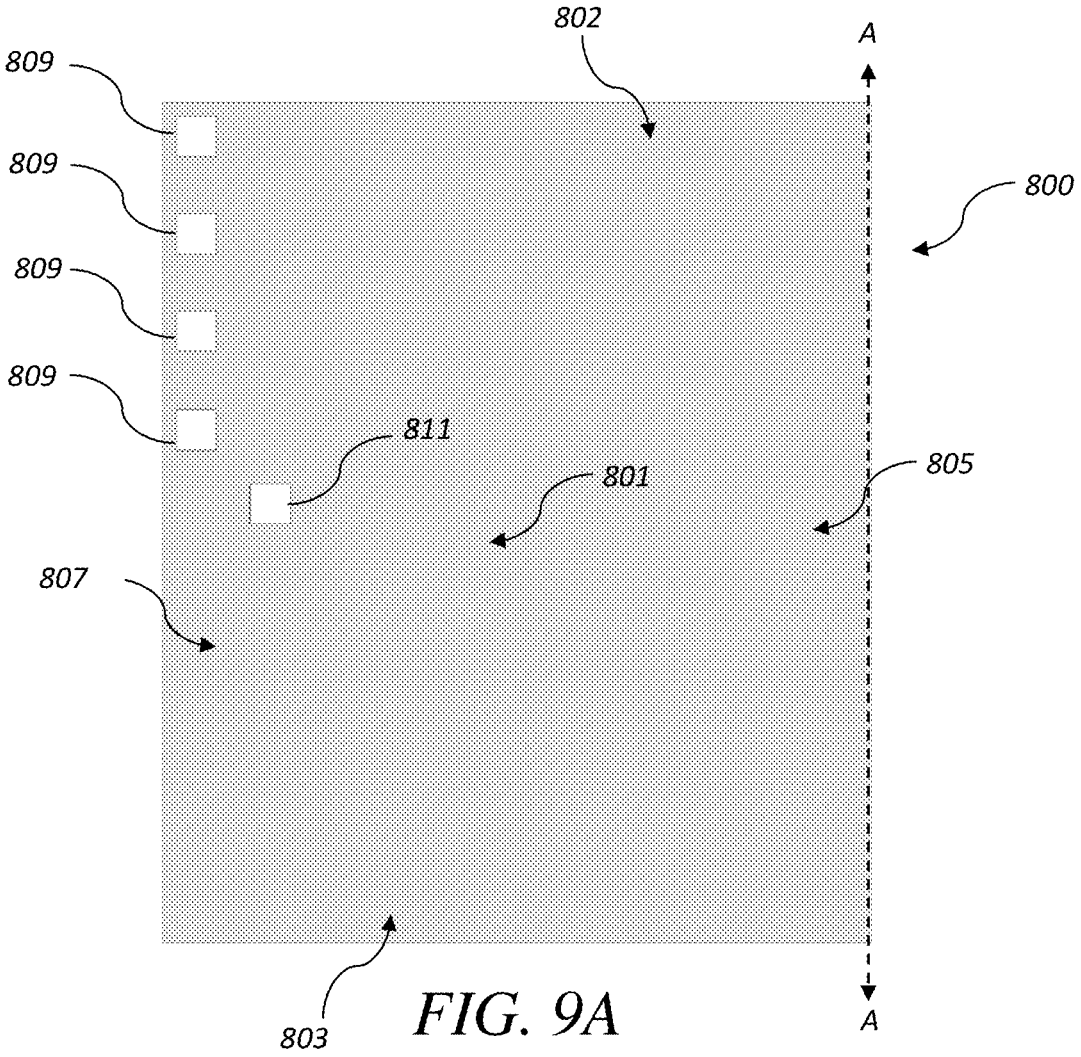
FIG. 9A is an elevational view of a first surface of another example pouch in an unwrapped configuration.
Figure 9B:
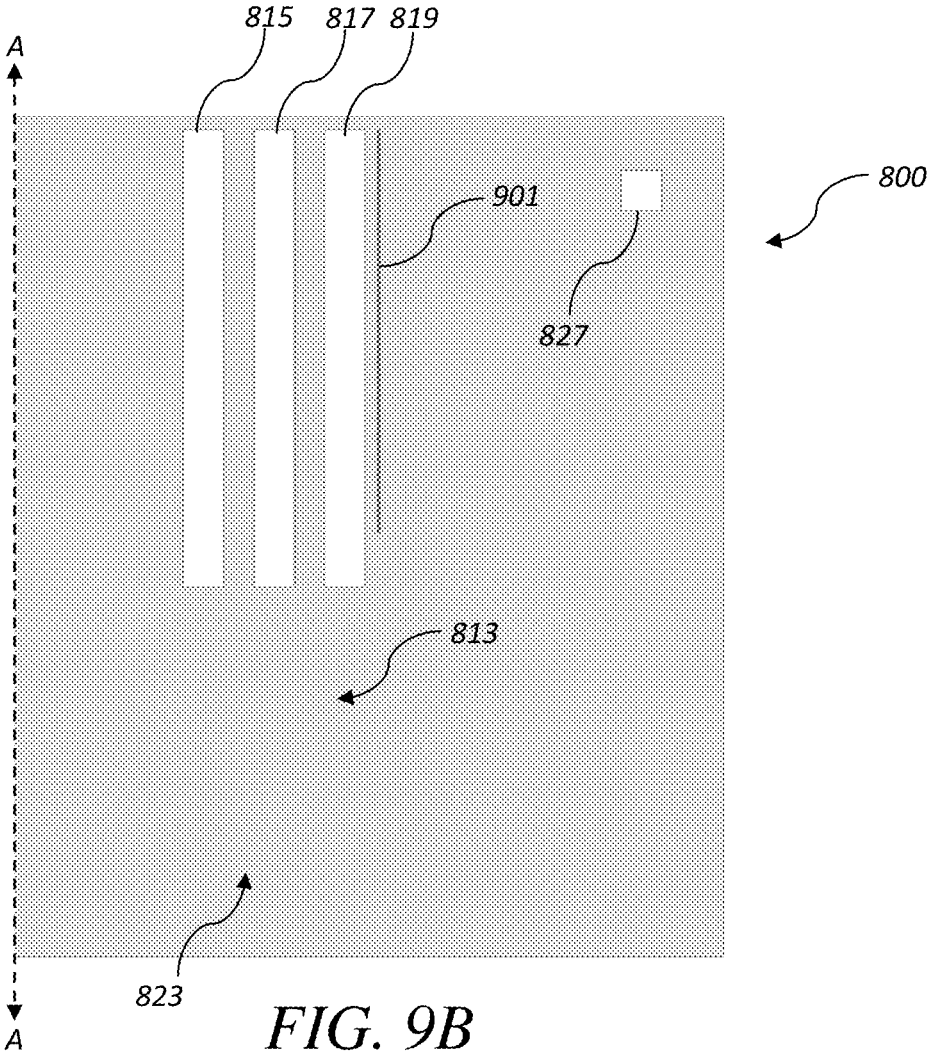
FIG. 9B is an elevational view of a second surface of a pouch in an unwrapped configuration, the second surface being opposite the first surface depicted in FIG. 9A.

FIGS. 9A-9D show example components of another swaddling embodiment. In this embodiment, the blanket 829 (FIGS. 9C and 9D) is fixed to pouch 800 (FIGS. 9A and 9B). Specifically, the blanket 829 (FIGS. 9C and 9D) is fixed to pouch 800 (FIGS. 9A and 9B) with a sewn seam.

The configuration of the first surface 801 of pouch 800 in FIG. 9A is generally the same as the configuration of FIG. 8A. The foregoing discussion of the first surface of the pouch 800 is incorporated by reference.

The configuration of the second surface of the pouch 800 in FIG. 9B is similar to the configuration of FIG. 8B. The foregoing discussion of the second surface of the pouch 800 is also incorporated by reference. A difference between the second surface 813 shown in FIG. 8B and the second surface 813 shown in FIG. 9B is that, in FIG. 9B, attachment 825 (FIG. 8B) is replaced with seam 901 (FIG. 9B). Seam 901 (FIG. 9B) is a sewn seam that fixes the pouch 800 to the blanket (not shown in FIG. 9B), as discussed below.

Figure 9C:
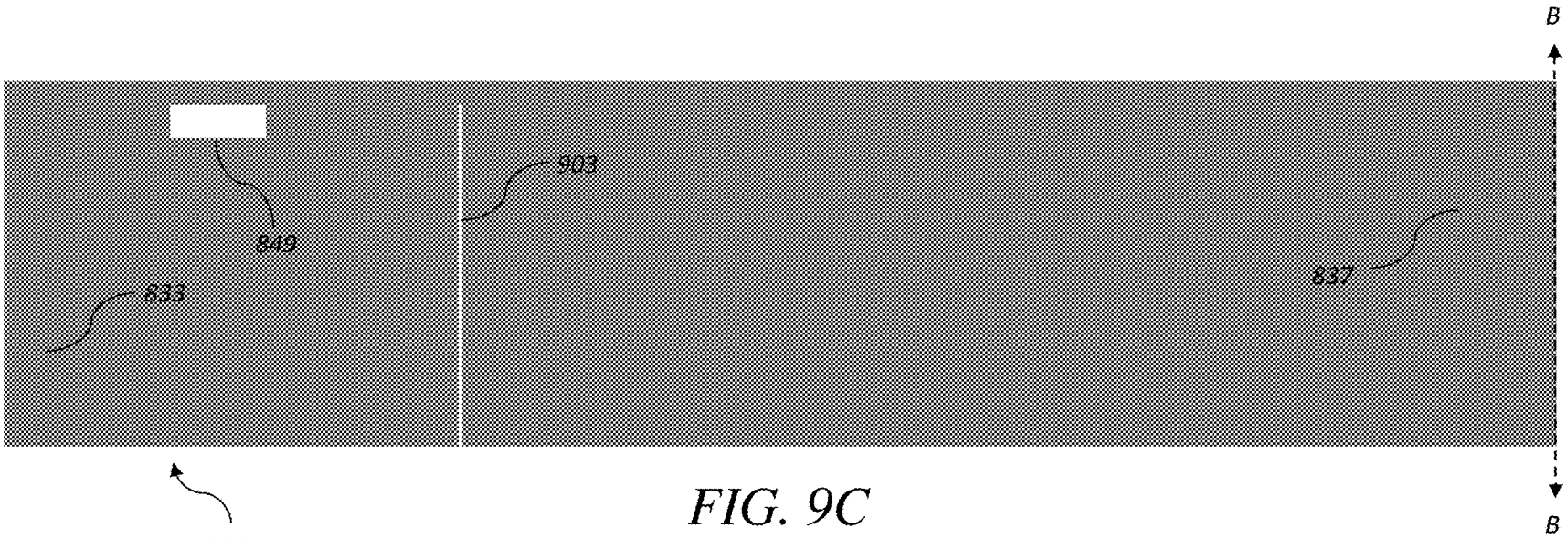
FIG. 9C is an elevational view of a first surface of a blanket in an unwrapped configuration, the blanket being complementary with the pouch of FIGS. 9A and 9B.
Figure 9D:
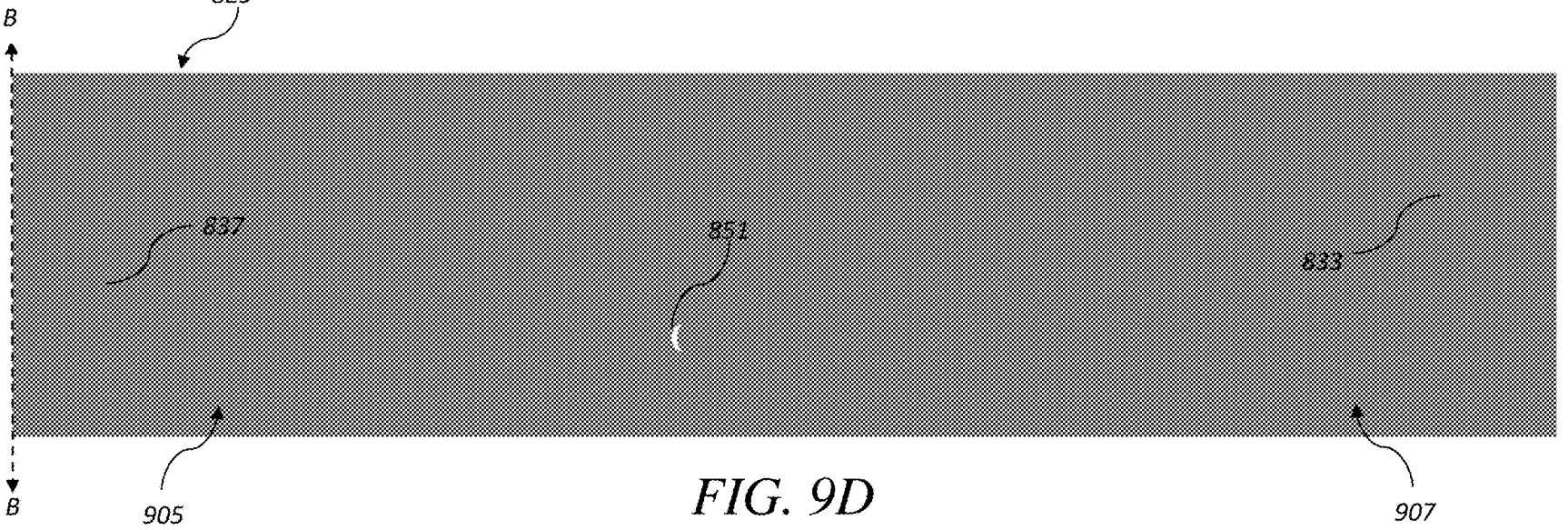
FIG. 9D is an elevational view of a second surface of a blanket, the second surface being opposite the surface depicted in FIG. 9C.

To complete a swaddling, a blanket can be attached to the pouch 800. Nevertheless, as discussed above, the blanket can be omitted, if desired, in certain embodiments. An example blanket 829 is shown in FIGS. 9C and 9D. These figures show a shape for the blanket 829 that is similar to the shape shown in FIG. 3.

FIG. 9C shows a first surface of the blanket 829. The first surface of the blanket 829, in use, is an inward facing surface that faces the second surface 813 (that is, the outward-facing surface) of the pouch 800 (FIG. 9B). Seam 903 (FIG. 9C) corresponds to seam 901 (FIG. 9B). Together, seams 901, 903 fix the pouch 800 (FIG. 8B) to the blanket 829 (FIG. 9C).

FIG. 9D shows a second surface of the blanket 829 opposite the first surface depicted in FIG. 9C. In use, the second surface of the blanket 829 faces outward. Line B-B shows the axis of rotation from FIG. 9C to FIG. 9D.

In the example embodiment of FIGS. 9C and 9D, attachment 849 (FIG. 9C) of the blanket 829 removably attaches to attachment 827 (FIG. 9B) of the pouch. Here, attachment 849 is a tab of hook fabric, and attachment 829 is a tab of loop fabric. However, any suitable attachment means can be used for the attachments 849, 827. Attachments 849, 827 can advantageously provide guidance on placement of the blanket 829 and/or reduce the possibility of the blanket 829 slipping from its desired placement. Furthermore, more or fewer than one attachment pair can be used to removably attach the blanket 829 (FIG. 9C) to the pouch 800 (FIG. 9B). For example, the attachments can be omitted. As another example, two or three attachment pairs can provide a more secure connection between the blanket 829 (FIG. 9C) and the pouch 800 (FIG. 9B). It should be appreciated that, although the configuration of FIGS. 9B and 9C may be preferred in certain embodiments, other configurations may be utilized in other embodiments as may be desired.

The blanket 829 can be wrapped around the infant. FIG. 9D shows the surface of the blanket 829 that faces outward when the blanket 829 is to be wrapped around the infant. In this example, first blanket flap 833 is draped or otherwise wrapped over the front of the infant. Second blanket flap 837 is wrapped such that it crosses over first blanket flap 833 and wraps around the infant. Second blanket flap 837 is bunched and passed through loop 851. Loop 851 holds second blanket flap 837 in place around the infant. It was discovered that loop 851 can also advantageously reduce the possibility of the blanket 829 creeping during use and bunching around the neck. In this example, loop 851 is an elastic loop that is sewn on the blanket 829 to secure it in place. However a variety of different techniques can be used to hold second blanket flap 837 in place around the infant. For example, second blanket flap 837 and the outward facing surface of the blanket 829 can use suitable attachment means to hold the second blanket flap 837 in place around the infant. Suitable attachments means are described in this disclosure and are incorporated in this discussion by reference.

Figure 10A:
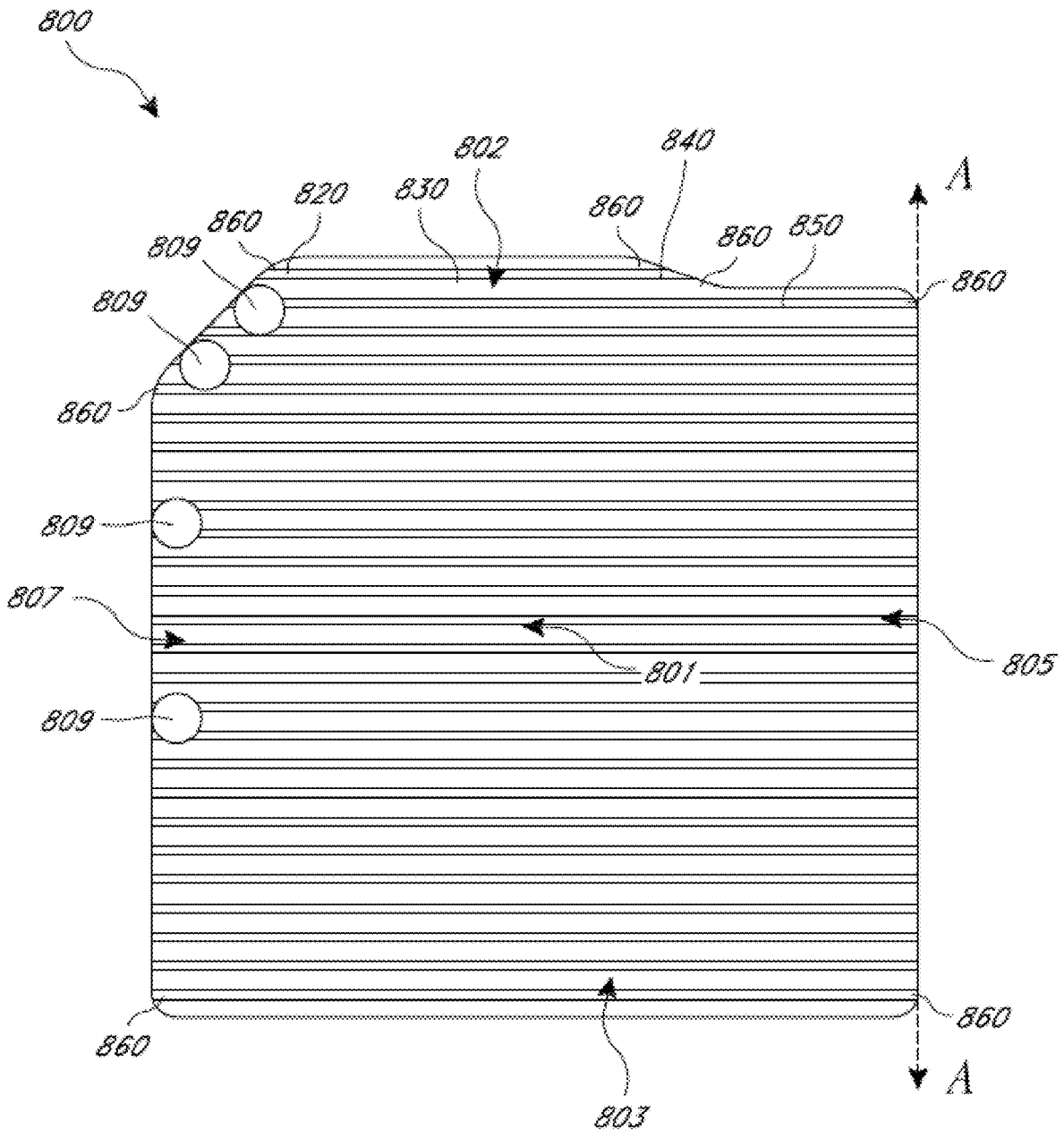
FIG. 10A is an elevational view of a first surface of a pouch in an unwrapped configuration.
Figure 10B:
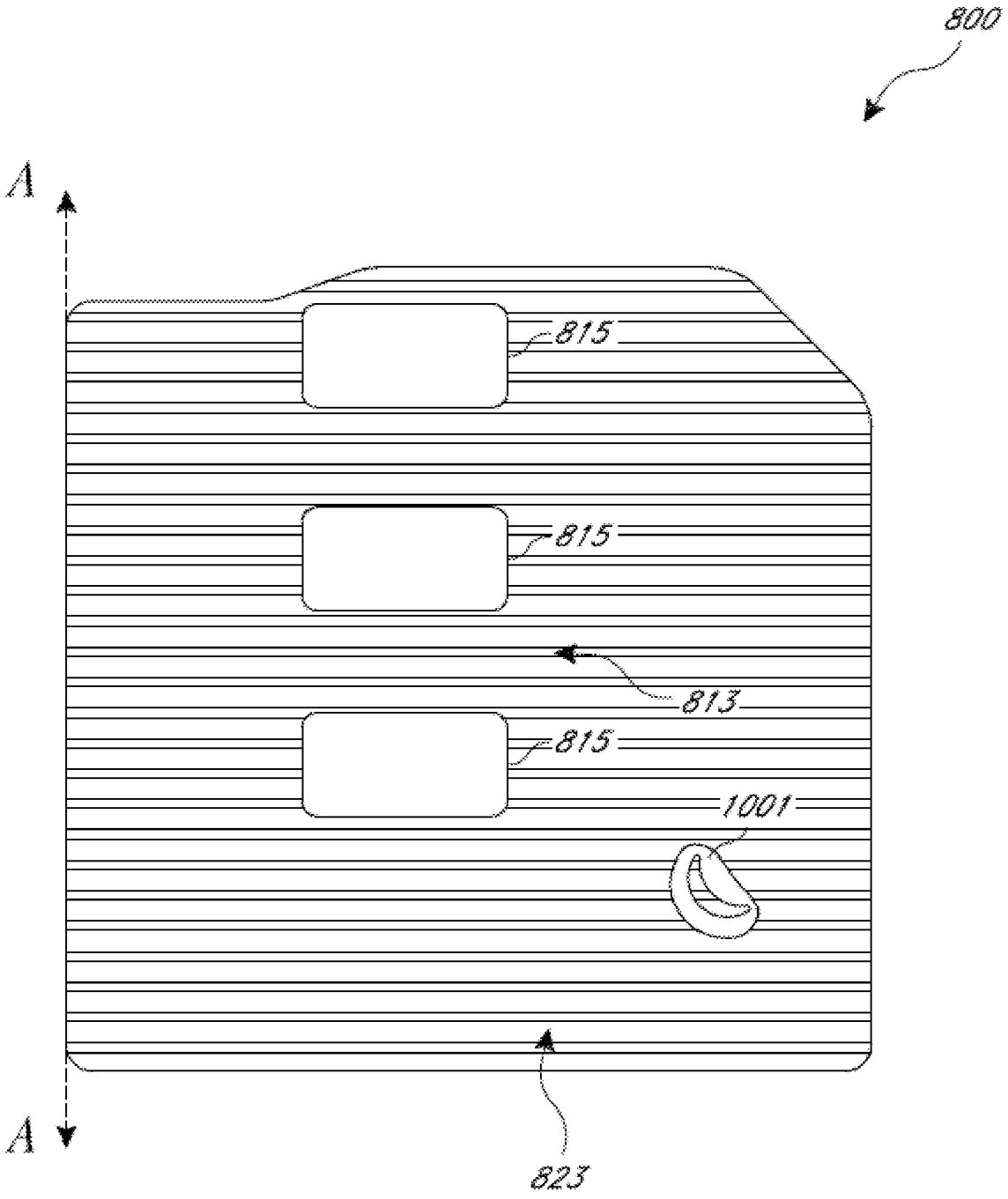
FIG. 10B is an elevational view of a second surface of a pouch, the second surface being opposite the surface depicted in FIG. 10A.

FIGS. 10A-10B show another example swaddling embodiment. This example includes a pouch 800. Although the embodiment is shown without a blanket or a head cover, a blanket and/or a head cover can be incorporated, if desired, as discussed herein.

As shown in FIGS. 10A-10B, the pouch opens to lay flat. In at least one example method of positioning the pouch 800 on a baby, the first surface 801 of FIG. 10A contacts the baby. For example, the baby can be placed on the first surface 801 such that the baby is placed generally offset (e.g., left-of-center) from the conceptual vertical centerline on the first surface 801. The baby's back can contact the first surface 801, and the baby's chest can face away from the first surface 801.

In FIG. 10A, the top portion 802 includes a first sloped section 820, an upper section 830, a second sloped section 840, and a lower section 850. Lower section 850 comprises an upper edge that is spaced apart from the upper edge of upper section 830. At least a portion of an upper edge of lower section 850 is closer to the conceptual horizontal center line of pouch 800 than an upper edge of the upper section 830. In this example, the upper edge of upper section 830 is generally horizontal. The upper edge of lower section 850 can be generally horizontal, as shown in the example of FIG. 10A. Nevertheless, other configurations of upper section 830 and lower section 850, including shaped and sloped configurations, are also contemplated.

Also in the example of FIG. 10A, each of the junctions between (1) the side edge of second side 807 and the upper edge of first sloped section 820, (2) the upper edge of first sloped section 820 and the upper edge of upper section 830, (3) the upper edge of upper section 830 and the upper edge of second sloped section 840, (4) the upper edge of second sloped section 840 and the upper edge of lower section 850, (5) the upper edge of lower section 850 and side edge of first side 805, (6) the side edge of first side 805 and the lower edge of lower portion 803, and (7) the lower edge of lower portion 803 and the side edge of second side 807 comprise fillets 860. As used, herein, the term fillet refers to a rounded interior or exterior corner and includes, without limitation, convex and concave junctions. Nevertheless, straight angled corners are also suitable and are contemplated in certain embodiments for any or all of the foregoing junctions.

The upper edge of first sloped section 820 extends between and slopes upward from the side edge of second side 807 to the upper edge of upper section 830. In certain embodiments, the angle between the upper edge of first sloped section 820 and the upper edge of upper section 830 is an obtuse angle, such as about 140° and for example 136°. The upper (or outer) edge of first sloped section 820 also can be a generally vertical line, such that the slope=∞ or the slope≈∞.

The upper edge of second sloped section 840 extends between and slopes downward from the upper edge of upper section 830 to the upper edge of lower section 850. In certain embodiments, the angle between the upper edge of second sloped section 840 and the upper edge of upper section 830 is an obtuse angle, such as about 160° and for example 161°. The upper (or outer) edge of second sloped section 840 also can be a generally vertical line, such that the slope=∞ or the slope≈∞.

Desirably, the nape of the baby's neck is proximal the top portion 802 of the first surface 801 near upper section 830. Preferably, the baby's head extends beyond the top portion 802 at upper section 830. The baby's feet extend toward the lower portion 803 of the first surface 801. To use the pouch 800, a first side 805 of the first surface 801 is folded over the baby's chest such that the lower section 850 of the top portion 802 is positioned under the baby's chin region. A second side 807 of the first surface 801 is folded over the first side 805. First sloped section 820 is positioned under the baby's chin region when in use. Certain embodiments include the realization that incorporating the upper section 830, lower section 850, and first sloped section 820 can help keep the nape of the baby's neck warm and secure while keeping the baby's mouth and/or nose clear of fabric.

FIG. 10B shows a second surface 813 of the pouch 800 opposite the first surface 801 depicted in FIG. 10A. Line A-A shows the axis of rotation from FIG. 10A to FIG. 10B.

As discussed below, the configuration of FIGS. 10A and 10B can be advantageous because the configuration allows the pouch 800 size to be adjusted to accommodate an infant's growth to accommodate different sized infants.

Referring again to FIG. 10A, the first surface 801 comprises first attachment 809. As used herein, "attachment" broadly refers to a single mechanism or plural elements for attaching. In this example, the first attachment 809 comprises a plurality of rounds of hook fabric and, more specifically, four rounds of hook fabric. However, a variety of suitable first attachment 809 elements can be used. Moreover, first attachment 809 can comprise more or fewer elements. For example, the first attachment 809 can comprise one or more of the following means for attaching: loop fabric (a single or plural rounds or tabs, a single or plural strips, or other suitable elements or configurations), hook fabric (a single or plural rounds or tabs, a single or plural strips, or other suitable elements or configurations), one or more male halves of a snap fastener, one or more female halves of a snap fastener, a half of a zipper, one or more buttons, one or more button holes or rings, one or more strings, one or more ties, and equivalents thereof.

In this example, two first attachment 809 elements are near the upper edge of first sloped section 820, and two first attachment 809 elements are near the side edge of second side 807. Nevertheless, other positions are contemplated. For example, all elements can be positioned near the side edge of second side 807. One element can be positioned near the upper edge of the first sloped section 820 and another element can be positioned near the side edge of second side 807. Other configurations are possible.

Referring now to FIG. 10B, the second surface 813 comprises a second attachment 815 that is complementary with the first attachment 809. In this example, the first attachment 815 comprises a plurality of elongated tabs of loop fabric and, more specifically, three elongated tabs of loop fabric. Preferably, the corners of the elongated tabs are filleted to reduce the possibility of the baby contacting sharp corners. The plural tabs of the second attachment 815 are spaced vertically along the second surface 813. The loop fabric of the second attachment 815 is complementary with the hook fabric of the first attachment 809. The compliance of other fastener types is generally known in the art.

After the second side 807 of the first surface 801 is folded over the first side 805, as shown in FIG. 10A, first attachment 809 will face the complementary second attachment 815 shown in FIG. 10B. The top two rounds of the first attachment 809 (FIG. 10A) can be removably attached to the top tab of the second attachment 815 (FIG. 10B). Certain embodiments include the realization that plural first attachment 809 elements provide extra positionability and reinforcement when joining the first attachment 809 (FIG. 10A) to the second attachment 815 (FIG. 10B) near the top portion 802 (FIG. 10A) to help ensure the baby's mouth and/or nose is clear of fabric. The third round from the top of the first attachment 809 (FIG. 10A) can be removably attached to the middle tab of the second attachment 815 (FIG. 10B) The bottom round of the first attachment 809 (FIG. 10A) can be removably attached to the bottom tab of the second attachment 815 (FIG. 10B).

Certain embodiments include the realization that the laterally elongated tabs of the second attachment 815 (FIG. 10B) can advantageously improve the adjustability of the pouch 800 size. In addition, certain embodiments include the realization that elongated tabs having a much larger size than the rounds can further improve adjustability. Specifically, the elongated shapes of the tabs of the second attachment 815 (FIG. 10B) can allow the first attachment 809 (FIG.

10A) to be suitably joined at various positions to securely accommodate different sized infants.

In various embodiments, the maximum lateral length of a member of the second attachment 815 is at least 2 (or at least about 2), at least 3 (or at least about 3), at least 4 (or at least about 4), or at least 5 (or at least about 5) times longer than the maximum lateral length of a member of the first attachment 809. For example, the maximum lateral length of a member of the second attachment 815 can be 6 in (or about 6 in) (15 cm (or about 15 cm)). The maximum lateral length of a member of the first attachment 809 can be 1.5 in (or about 1.5 in) (3.75 cm (or about 3.75 cm)).

The maximum vertical length of a member of the second attachment 815 can be at least 1.25 (or at least about 1.25), at least 1.5 (or at least about 1.5), at least 2 (or at least about 2), or at least 3 (or at least about 3) times longer than the maximum vertical length of a member of the first attachment 809. For example, the maximum vertical length of a member of the second attachment 815 can be 3 in (or about 3 in) (7.5 cm (or about 7.5 cm)). The maximum vertical length of a member of the first attachment 809 can be 1.5 in (or about 1.5 in) (3.75 cm (or about 3.75 cm)).

The surface area of a member of the second attachment 815 can be at least 6 times (or at least about 6 times), at least 8 times (or at least about 8 times), at least 10 times (or at least about 10 times), or at least 12 times (or at least about 12 times) larger than the surface area of a member of the first attachment 809. For example, the surface area of a member of the second attachment 815 can be 18 $in^2$ (or about 18 $in^2$) (116 $cm^2$ (or about 116 $cm^2$)). The surface area of a member of the first attachment 815 can be 1.77 $in^2$ (or about 1.77 $in^2$) (11.4 $cm^2$ (or about 11.4 $cm^2$)).

The foregoing dimensions are provided as examples of suitable configurations. Other dimensions are possible and are within the scope of the invention.

The configuration of FIGS. 10A and 10B also can be advantageous because the configuration allows the pouch 800 to be easily opened to allow a diaper to be changed or to take a rectal temperature.

For example, when first attachment 809 (FIG. 10A) is removably attached to second attachment 815 (FIG. 10B), the lower portion 823 (FIG. 10B) of the outward-facing second surface 813 (FIG. 10B) is open, allowing access to the infant near the infant's feet or bottom. The size of the opening can be further increased by detaching a bottom one or two tabs of first attachment 809 (FIG. 10A).

If desired, to close access through the lower portion 823 (FIG. 10B), the lower portion 823 can be gathered and passed through loop 1001. It was discovered that loop 1001 can also advantageously reduce the possibility of the lower portion 823 of the pouch 800 creeping during use. In this example, loop 1001 is an elastic loop that is sewn on the second surface 813 to secure it in place. However a variety of suitable retainers can be used to hold the lower portion 823 in place. For example, a compression clip or magnetic closure can be used in place of or in conjunction with loop 1001. Other suitable attachment means and techniques are described in this disclosure and are incorporated in this discussion by reference.

Figure 11A:
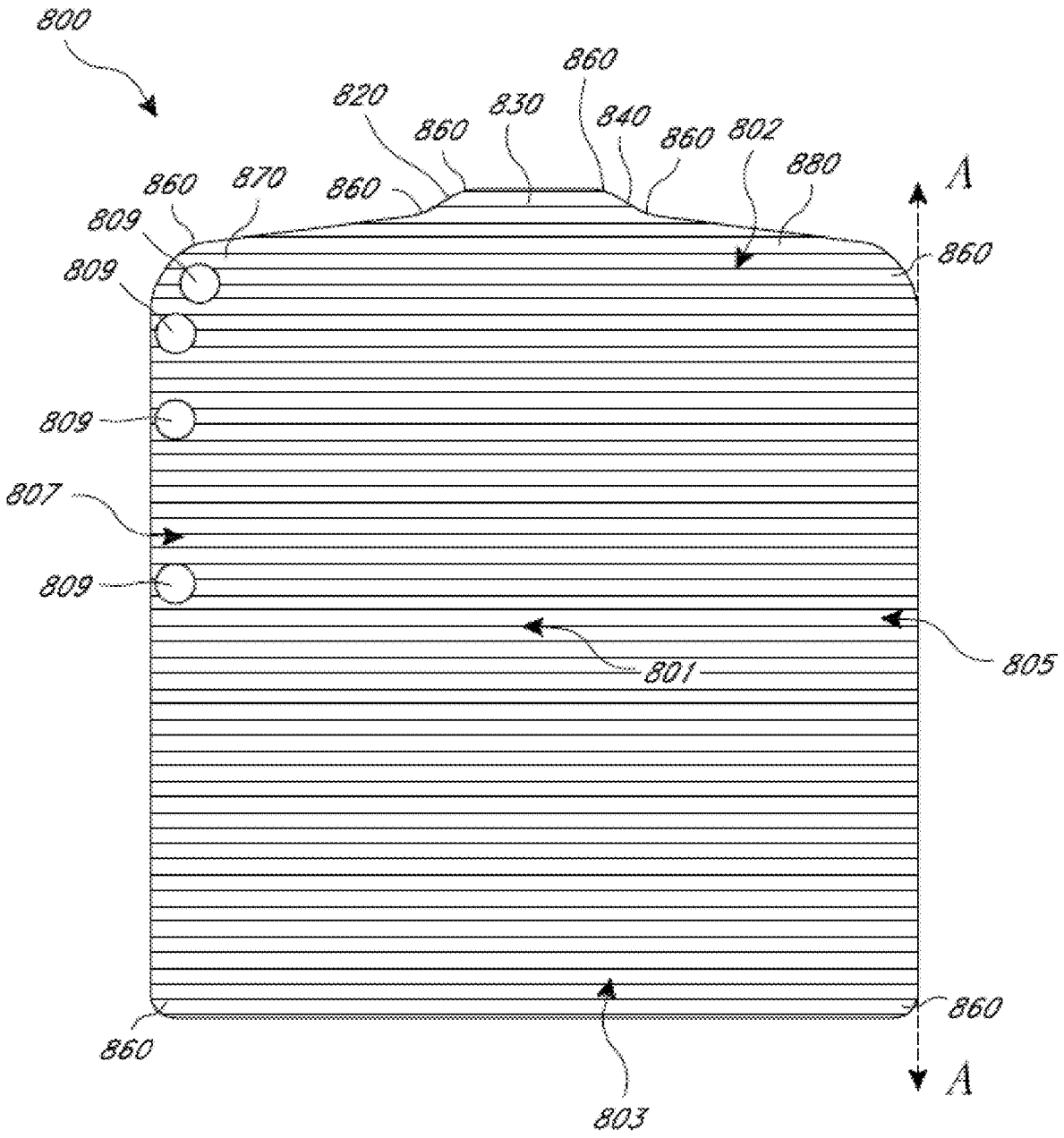
FIG. 11A is an elevational view of a first surface of a pouch in an unwrapped configuration.
Figure 11B:
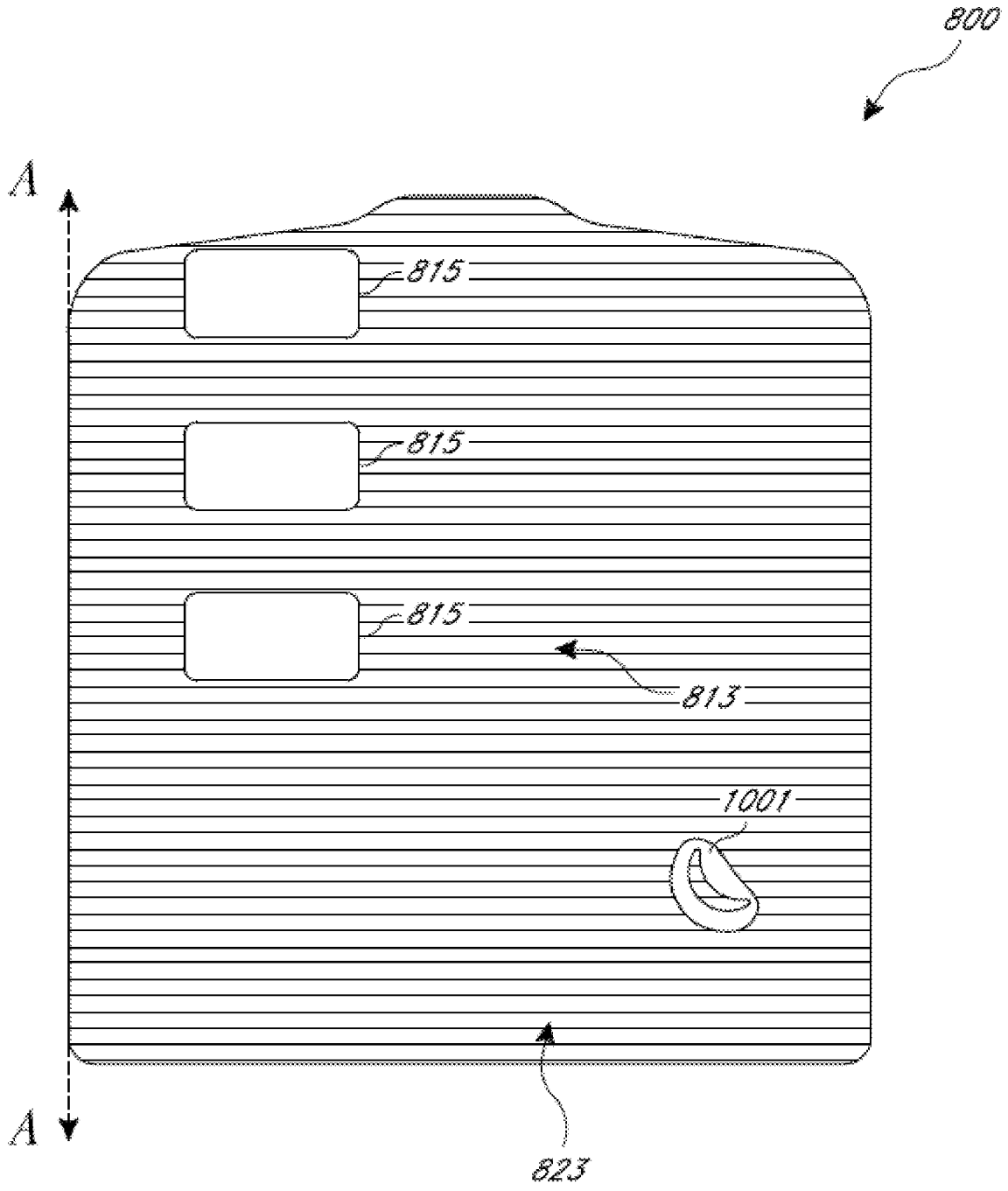
FIG. 11B is an elevational view of a second surface of a pouch, the second surface being opposite the surface depicted in FIG. 11A.

FIGS. 11A-11B show another example swaddling embodiment. This example includes a pouch 800. Although the embodiment is shown without a blanket or a head cover, a blanket and/or a head cover can be incorporated, if desired, as discussed herein.

As shown in FIGS. 11A-11B, the pouch opens to lay flat. In at least one example method of positioning the pouch 800 on a baby, the first surface 801 of FIG. 11A contacts the baby. For example, the baby can be placed on the first surface 801 such that the baby is placed generally in line with the conceptual vertical centerline on the first surface 801. The baby's back can contact the first surface 801, and the baby's chest can face away from the first surface 801.

In FIG. 11A, the top portion 802 includes a first lower section 870, a first sloped section 820, an upper section 830, a second sloped section 840, and a second lower section 880. At least a portion of an upper edge of upper section 830 is farther from the conceptual horizontal center line of pouch 800 than an upper edge of the first lower section 870 or second lower section 880. In this example, the upper edge of upper section 830 is generally horizontal, the upper edge of first lower section 870 slopes upward from the side edge of second side 807 to the upper edge of first sloped section 820, and the upper edge of second lower section 880 slopes upward from the side edge of first side 805 to the upper edge of second sloped section 840. Nevertheless, other configurations, including shaped configurations, are also contemplated.

Also in the example of FIG. 11A, each of the junctions between (1) the side edge of second side 807 and the upper edge of first lower section 870, (2) the upper edge of first lower section 870 and the upper edge of first sloped section 820, (3) the upper edge of first sloped section 820 and the upper edge of upper section 830, (4) the upper edge of first sloped section 820 and the upper edge of second sloped section 840, (5) the upper edge of second sloped section 840 and upper edge of second lower section 880, (6) the upper edge of second lower section 880 and the side edge of first side 805, (7) the side edge of first side 805 and the lower edge of lower portion 803, and (8) the lower edge of lower portion 803 and the side edge of second side 807 comprise fillets 860. Nevertheless, straight angled corners are also suitable and are contemplated in certain embodiments for any or all of the foregoing junctions.

In this example, the upper edge of first lower section 870 extends between and slopes upward from the side edge of second side 807 to the upper edge of first sloped section 820. In certain embodiments, the angle between the upper edge of first lower section 870 and the upper edge of first sloped section 820 is an obtuse angle, such as about 160° and for example 161°. Nevertheless, other configurations are contemplated. For example, the upper (or outer) edge of first lower section 870 also can be a generally horizontal line extending from the side edge of second side 807 to the upper edge of first sloped section 820, such that the slope=0 or the slope≈0. Also in this example, the upper edge of first sloped section 820 extends between and slopes upward from the upper edge of first lower section 870 to the upper edge of upper section 830. In certain embodiments, the angle between the upper edge of first sloped section 820 and the upper edge of upper section 830 is an obtuse angle, such as about 150° and for example 153°. The upper (or outer) edge of first sloped section 820 also can be a generally vertical line, such that the slope=∞ or the slope≈∞.

Also in this example, the upper edge of second sloped section 840 extends between and slopes downward from the upper edge of upper section 830 to the upper edge of second lower section 880. In certain embodiments, the angle between the upper edge of second sloped section 840 and the upper edge of upper section 830 is an obtuse angle, such as about 150° and for example 153°. The upper (or outer) edge of second sloped section 840 also can be a generally vertical line, such that the slope=∞ or the slope≈∞. Also in this example, the upper edge of second lower section 880 extends between and slopes downward from the upper edge of second sloped section 840 to the side edge of first side 805. In certain embodiments, the angle between the upper edge of second lower section 880 and the upper edge of second sloped section 840 is an obtuse angle, such as about 160° and for example 161°. Nevertheless, other configurations are contemplated. For example, the upper (or outer) edge of second lower section 880 also can be a generally horizontal line extending from the upper edge of second sloped section 840 to the side edge of first side 805, such that the slope=0 or the slope≈0.

Desirably, the nape of the baby's neck is proximal the top portion 802 of the first surface 801 near upper section 830. Preferably, the baby's head extends beyond the top portion 802 at upper section 830. The baby's feet extend toward the lower portion 803 of the first surface 801. To use the pouch 800, a first side 805 of the first surface 801 is folded over the baby's chest such that at least a portion of the upper edge of second lower section 880 is positioned under the baby's chin region. Optionally, at least a portion of the upper edge of the second lower section 880 can be positioned over the baby's shoulder. A second side 807 of the first surface 801 is folded over the first side 805. At least a portion of first lower section 870 is also positioned under the baby's chin region when in use. Optionally, at least a portion of the upper edge of the first lower section 870 can be positioned over the baby's opposite shoulder. Certain embodiments include the realization that the foregoing configuration can help keep the nape of the baby's neck warm and secure while keeping the baby's mouth and/or nose clear of fabric.

FIG. 11B shows a second surface 813 of the pouch 800 opposite the first surface 801 depicted in FIG. 11A. Line A-A shows the axis of rotation from FIG. 11A to FIG. 11B.

As discussed below, the configuration of FIGS. 11A and 11B can be advantageous because the configuration allows the pouch 800 size to be adjusted to accommodate an infant's growth to accommodate different sized infants.

Referring again to FIG. 11A, the first surface 801 comprises first attachment 809. In this example, the first attachment 809 comprises a plurality of rounds of hook fabric and, more specifically, four rounds of hook fabric. However, a variety of suitable first attachment 809 elements can be used. Moreover, first attachment 809 can comprise more or fewer elements. For example, the first attachment 809 can comprise one or more of the following means for attaching: loop fabric (a single or plural rounds or tabs, a single or plural strips, or other suitable elements or configurations), hook fabric (a single or plural rounds or tabs, a single or plural strips, or other suitable elements or configurations), one or male halves of a snap fastener, one or more female halves of a snap fastener, a half of a zipper, one or more buttons, one or more button holes or rings, one or more strings, one or more ties, and equivalents thereof. In this example, one element is near the fillet 860 forming the junction between the side edge of the second side 807 and the upper edge of the first lower section 870, and three elements are near the side edge of second side 807. Nevertheless, other positions are contemplated. For example, all elements can be positioned near the side edge of second side 807. Plural elements can be positioned near the fillet 860 forming the junction between the side edge of the second side 807 and the upper edge of the first lower section 870. Other configurations are possible.

Referring still to FIG. 11B, the second surface 813 comprises a second attachment 815 that is complementary with the first attachment 809. In this example, the first attachment 815 comprises a plurality of elongated tabs of loop fabric and, more specifically, three elongated tabs of loop fabric. Preferably, the corners of the elongated tabs are filleted to reduce the possibility of the baby contacting sharp corners. The plural tabs of the second attachment 815 are spaced vertically along the second surface 813. The loop fabric of the second attachment 815 is complementary with the hook fabric of the first attachment 809. The compliance of other fastener types is generally known in the art.

After the second side 807 of the first surface 801 is folded over the first side 805, as shown in FIG. 11A, first attachment 809 will face the complementary second attachment 815 shown in FIG. 11B. The top two elements of the first attachment 809 (FIG. 11A) can be removably attached to the top tab of the second attachment 815 (FIG. 11B). Certain embodiments include the realization that plural elements provide extra positionability and reinforcement when joining the first attachment 809 (FIG. 11A) to the second attachment 815 (FIG. 11B) near the top portion 802 (FIG. 11A) to help ensure the baby's mouth and/or nose is clear of fabric. The third element from the top of the first attachment 809 (FIG. 11A) can be removably attached to the middle tab of the second attachment 815 (FIG. 11B). The bottom element of the first attachment 809 (FIG. 11A) can be removably attached to the bottom tab of the second attachment 815 (FIG. 11B).

Certain embodiments include the realization that the laterally elongated tabs of the second attachment 815 (FIG. 11B) can advantageously improve the adjustability of the pouch 800 size. In addition, certain embodiments include the realization that elongated tabs having a much larger size than the element can further improve adjustability. Specifically, the elongated shapes of the tabs of the second attachment 815 (FIG. 11B) can allow the first attachment 809 (FIG. 11A) to be suitably joined at various positions to securely accommodate different sized infants.

In various embodiments, the maximum lateral length of a member of the second attachment 815 is at least 2 (or at least about 2), at least 3 (or at least about 3), at least 4 (or at least about 4), or at least 5 (or at least about 5) times longer than the maximum lateral length of a member of the first attachment 809. For example, the maximum lateral length of a member of the second attachment 815 can be 6 in (or about 6 in) (15 cm (or about 15 cm)). The maximum lateral length of a member of the first attachment 809 can be 1.5 in (or about 1.5 in) (3.75 cm (or about 3.75 cm)).

The maximum vertical length of a member of the second attachment 815 can be at least 1.25 (or at least about 1.25), at least 1.5 (or at least about 1.5), at least 2 (or at least about 2), or at least 3 (or at least about 3) times longer than the maximum vertical length of a member of the first attachment 809. For example, the maximum vertical length of a member of the second attachment 815 can be 3 in (or about 3 in) (7.5 cm (or about 7.5 cm)). The maximum vertical length of a member of the first attachment 809 can be 1.5 in (or about 1.5 in) (3.75 cm (or about 3.75 cm)).

The surface area of a member of the second attachment 815 can be at least 6 times (or at least about 6 times), at least 8 times (or at least about 8 times), at least 10 times (or at least about 10 times), or at least 12 times (or at least about 12 times) larger than the surface area of a member of the first attachment 809. For example, the surface area of a member of the second attachment 815 can be 18 $in^2$ (or about 18 $in^2$) (116 $cm^2$ (or about 116 $cm^2$)). The surface area of a member of the first attachment 815 can be 1.77 $in^2$ (or about 1.77 $in^2$) (11.4 $cm^2$ (or about 11.4 $cm^2$)).

The foregoing dimensions are provided as examples of suitable configurations. Other dimensions are possible and are within the scope of the invention.

It should be appreciated that, although the configuration of FIGS. 11A and 11B may be preferred in certain embodiments, other configurations, including other variations discussed herein, may be utilized in other embodiments as may be desired.

The configuration of FIGS. 11A and 11B also can be advantageous because the configuration allows the pouch 800 to be easily opened to allow a diaper to be changed or to take a rectal temperature.

For example, when first attachment 809 (FIG. 11A) is removably attached to second attachment 815 (FIG. 11B), the lower portion 823 (FIG. 11B) of the outward-facing second surface 813 (FIG. 11B) is open, allowing access to the infant near the infant's feet or bottom. The size of the opening can be further increased by detaching a bottom one or two tabs of first attachment 809 (FIG. 11A).

If desired, to close access through the lower portion 823 (FIG. 11B), the lower portion 823 can be gathered upwards passed through loop 1001. It was discovered that loop 1001 can also advantageously reduce the possibility of the lower portion 823 of the pouch 800 creeping during use. In this example, loop 1001 is an elastic loop that is sewn on the second surface 813 to secure it in place. However a variety of suitable retainers can be used to hold the lower portion 823 in place. For example, a compression clip or magnetic closure can be used in place of or in conjunction with loop 1001. Other suitable attachment means and techniques are described in this disclosure and are incorporated in this discussion by reference.

The foregoing description of the invention includes preferred forms thereof. Modifications may be made thereto without departing from the scope of the invention. To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

Through the description and the claims, the terms "comprises," "comprising," and the like are to be construed in an inclusive sense, that is, in the sense of "including but not limited to," unless the context clearly requires otherwise.

Although the invention has been described by way of example and with reference to possible embodiments thereof, it is to be understood that modifications or improvements may be made thereto without departing from the spirit and scope of the invention and without diminishing its attendant advantages. Furthermore, where reference has been made to specific components or integers of the invention having known equivalents, such equivalents are herein incorporated as if individually set forth.

Any discussion of the prior art throughout the specification should in no way be considered as an admission that such prior art is widely known or forms part of the common general knowledge in the field anywhere in the world.

What is claimed is:

1. An infant swaddling comprising:
an upper portion comprising:
a first upper flap,
a second upper flap, and
an upper edge, wherein, in use, an infant's head extends above the upper edge;
a lower portion comprising:
a first lower flap continuous with the first upper flap,
a second lower flap continuous with the second upper flap, and
a lower edge, wherein, in use, an infant's feet extend above the lower edge;
an outward-facing surface of the first upper flap comprising a first attachment having a first surface area;
an inner-facing surface of the second upper flap comprising a second attachment having a second surface area,
wherein the first upper flap is configured to be positioned over the chest of the infant and the second upper flap is configured to be positioned over the chest of the infant after the first upper flap is positioned, wherein the second attachment is configured to be secured to the first attachment after the first upper flap and the second upper flap are positioned, wherein the upper portion is configured to provide pressure around the chest of the infant; and
wherein the upper portion and the lower portion are independently secured, wherein the lower portion comprises a closure configured to secure the lower portion, wherein the closure comprises a loop, wherein the lower portion is configured to be gathered and passed through the loop, wherein the loop is fixed closer to a second side edge of the second lower flap than a first side edge of the first lower flap, wherein, in use, when the second attachment is secured to the first attachment, the lower portion is configured to be opened, allowing access to the infant near the infant's feet or bottom.

2. The infant swaddling of claim 1, wherein the upper portion and the lower portion are configured to apply different levels of compression to the infant.

3. The infant swaddling of claim 1, wherein the upper portion and the lower portion comprise a blend of polyester fibers and spandex fibers.

4. The infant swaddling of claim 1, wherein the upper portion and the lower portion comprise spandex fibers.

5. The infant swaddling of claim 1, wherein the first attachment comprises loop fabric and the second attachment comprises hook fabric.

6. The infant swaddling of claim 1, wherein the first surface area is at least about two times greater than the second surface area.

7. The infant swaddling of claim 1, wherein only the upper portion comprises hook and loop fasteners.

8. The infant swaddling of claim 1, wherein the first attachment and the second attachment are configured to be secured along the front of the infant, offset to a side of the infant, in use.

9. The infant swaddling of claim 1, wherein the upper portion and the lower portion comprises a moisture-wicking material.

10. A swaddling for an infant, the swaddling comprising:
an upper portion comprising:
a first upper flap,
a second upper flap, and
an upper edge, wherein, in use, an infant's head extends above the upper edge;
a lower portion comprising:
a first lower flap extending from the first upper flap,
a second lower flap extending from the second upper flap, and
a lower edge, wherein, in use, an infant's feet extend above the lower edge;
an outward-facing surface of the first upper flap comprising a first attachment having a first surface area;
an inner-facing surface of the second upper flap comprising a second attachment having a second surface area; and wherein the first upper flap is configured to be positioned at least partially around the infant and the second upper flap is configured to be positioned at least partially around the infant after the first upper flap is positioned, wherein the second attachment is configured to be secured to the first attachment after the first upper flap and the second upper flap are positioned; and a lower attachment configured to recloseably secure the lower portion, wherein the lower attachment comprises a loop, spaced apart from the lower edge, wherein the lower portion is configured to be gathered and passed through the loop, wherein the loop is fixed to the lower portion closer to a second side edge of the second lower flap than a first side edge of the first lower flap, wherein, in use, when the second attachment is secured to the first attachment, the lower attachment is configured to be opened, allowing access to the infant near the infant's feet or bottom.

11. The infant swaddling of claim 10, wherein the upper portion and the lower portion comprises a blend of polyester fibers and spandex fibers.

12. The swaddling of claim 10, wherein the upper portion comprises a moisture-wicking material.

13. The swaddling of claim 10, wherein the lower portion comprises a moisture-wicking material.

14. The infant swaddling of claim 10, wherein the first attachment and the second attachment have different lengths.

15. The swaddling of claim 10, wherein the first attachment comprises loop fabric and the second attachment comprises hook fabric.

16. The swaddling of claim 10, wherein the first surface area is greater than the second surface area.

17. The swaddling of claim 10, wherein the first attachment has a first spacing from a first side edge of the first upper flap and the second attachment has a second spacing from a second side edge of the second upper flap, the first spacing greater than the second spacing.

18. The swaddling of claim 10, wherein the first surface area has a first maximum lateral length and a first maximum vertical length, wherein the second surface area has a second maximum lateral length and a second maximum vertical length, wherein the first maximum lateral length is greater than the second maximum lateral length.

19. The swaddling of claim 10, wherein the first surface area has a first maximum lateral length and a first maximum vertical length, wherein the second surface area has a second maximum lateral length and a second maximum vertical length, wherein the first maximum vertical length is greater than the second maximum vertical length.

20. The swaddling of claim 1, wherein the first surface area is greater than the second surface area.

* * * * *